US011864614B2

(12) United States Patent
Whitesell et al.

(10) Patent No.: US 11,864,614 B2
(45) Date of Patent: Jan. 9, 2024

(54) PIVOT MECHANISM FOR A SHIELD FOR A HELMET

(71) Applicant: BELL SPORTS, INC., Scotts Valley, CA (US)

(72) Inventors: Scott S. Whitesell, Camarillo, CA (US); Lawrence Broers, Aptos, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 89 days.

(21) Appl. No.: 17/243,663

(22) Filed: Apr. 29, 2021

(65) Prior Publication Data

US 2022/0346487 A1 Nov. 3, 2022

(51) Int. Cl.
*A42B 3/22* (2006.01)

(52) U.S. Cl.
CPC ..... *A42B 3/222* (2013.01); *A42B 3/225* (2013.01)

(58) Field of Classification Search
CPC ..... A42B 3/222; A42B 3/225; A42B 3/223
See application file for complete search history.

(56) References Cited

U.S. PATENT DOCUMENTS

| | | | | |
|---|---|---|---|---|
| 5,177,816 | A * | 1/1993 | Schmidt | A42B 3/221 2/909 |
| 5,467,480 | A | 11/1995 | Baudou et al. | |
| 10,278,446 | B2 * | 5/2019 | Arai | A42B 3/227 |
| 2008/0072364 | A1 | 3/2008 | Schimpf | |
| 2013/0025015 | A1 * | 1/2013 | Isobe | A42B 3/222 2/10 |

OTHER PUBLICATIONS

Extended European Search Report and Written Opinion for related European Patent Application No. 22170673.2, dated Oct. 4, 2022.

* cited by examiner

*Primary Examiner* — Khoa D Huynh
*Assistant Examiner* — Erick I Lopez
(74) *Attorney, Agent, or Firm* — Reed Smith LLP; Walter M. Egbert, III; Richard J. Brown

(57) ABSTRACT

Disclosed is a pivot mechanism for a shield for a helmet, the pivot mechanism comprising a curved track having a first end and a second end; and a clamp slidingly engaged to the curved track, wherein the clamp is configured to attach to an end of the shield and slide along the track between a first position proximate to the first end of the curved track and a second position proximate to the second end of the curved track.

19 Claims, 15 Drawing Sheets

PIVOT MECHANISM FOR A SHIELD FOR A HELMET

TECHNICAL FIELD

This invention relates generally to helmets and more particularly to helmets with articulating and detachable eye or face shields.

BACKGROUND

Many people wear protective safety helmets while enjoying outdoor riding activities such as snowmobiling, motorcycle riding, and bicycling. While such helmets vary widely in design and features, many include an articulating shield that protects the eyes or face of the helmet wearer. Open face helmets have a hard shell that surrounds and covers the brow, crown and sides of the user's head, leaving the face open. A closed face motorcycle helmet has a hard shell that surrounds and covers a rider's head from the neck up and an eyeport through which the rider can see. In either design, a clear shield is hingedly or pivotably attached to the sides of the helmet and can be flipped down to cover the face or eyeport for normal use or flipped up out of the way when desired. The shield is typically formed of Plexiglas® or other clear plastic and tends to cover the face, either partially or completely. Such a clear face shield is often required for safety and to meet various regulatory requirements.

Certain motorcycle helmets include a pivotable, tinted inner shield which is inside of the normal pivotable face shield. Such a dual shield system is intended to reduce glare, block UV rays, etc. and thereby replace sunglasses during riding, while also allowing high visibility during low light and night conditions. Due to the dual-layer construction, such a pivotable internal shield is typically controlled by an external control lever. The external control lever allows the user to slide the sun shield up into concealment, or down to cover the eyes, without having to open the external face shield. Such a system is useful in wet or high speed conditions.

Conventional helmets comprise hingeplates on each side of the helmet to raise and lower the shield. Conventional hingeplates comprise a baseplate fixed to the helmet incorporating a pivot post on which a movable plate pivots, which is in turn connected to the shield to raise or lower the shield. These hingeplates can be complex and bulky and occupy volumes of the helmet where it would be desirable to include impact-absorbing material instead. This disadvantage is exacerbated in dual shield helmets, because their design requires that the arcs or articulation of the shields (or their 3D equivalents) are portions of concentric circles and/or spheres, respectively. This requires two hingeplates on each side of the helmet to be stacked together in the same region of the helmet to articulate the inner and outer shields.

Accordingly, there remains a need for an improved helmet and improved hingeplates or pivot mechanisms to articulate shields on helmets.

SUMMARY OF THE DISCLOSED SUBJECT MATTER

Conventional pivot mechanisms, also known as hingeplates, comprise a physical pivot about which the shield articulates. In contrast, the pivot mechanism described herein provides a "virtual pivot point" for the shield. That is, the pivot point for the shield is not a physical structure located at the shield's axis of rotation, but articulation of the shield is achieved by moving a clamp along a curved track with a radius of curvature centered at the pivot point.

In one aspect, this disclosure provides a pivot mechanism for a shield for a helmet, the pivot mechanism comprising a curved track having a first end and a second end; and a clamp slidingly engaged to the curved track, wherein the clamp is configured to attach to an end of the shield and slide along the track between a first position proximate to the first end of the curved track and a second position proximate to the second end of the curved track.

Embodiments of the pivot mechanism include the following, alone or in any combination.

The pivot mechanism wherein the clamp comprises a passageway wherein at least a portion of the interior surface of the passageway slidingly engages at least a portion of the exterior surface of the curved track; and a recess configured to engage the end of the shield to attach the clamp thereto.

The pivot mechanism comprising a track member comprising the curved track having the first end and the second end, an inside radius side, an outside radius side and a fixed width therebetween, a first raised portion proximate to the first end, and a second raised portion proximate to the second end; and a clamp comprising a clip member comprising a generally planar region having a first surface and an opposed second surface, and one or more raised portions on the first surface; and a slider member attached to the clip member, the slider member comprising a generally planar region having a first surface and a second surface, wherein the first surface of the clip member and the first surface of the slider member face each other and the generally planar region of the clip member and the generally planar region of the slider are spaced apart and substantially parallel, at least one first raised track engagement feature configured to slidably engage the inside radius side of the curved track, at least one second raised track engagement feature configured to slidably engage the outside radius side of the curved track, wherein a first portion of the generally planar region of the clip member, a first portion the generally planar region of the slider member, first raised track engagement feature, and the second raised track engagement feature define a passageway slidingly engaged around the curved track, and a second portion of the generally planar region of the clip member, and a second portion the generally planar region of the slider member define an open cavity for insertion of an end of the shield, and when a first portion of the clamp is in contact with the first raised portion of the track member, they define a first position of the clamp and when a second portion of the clamp is in contact with the second raised portion of the track member, they define a second position of the clamp.

The pivot mechanism wherein an end of a shield is inserted in the open cavity and is held therein.

The pivot mechanism further comprising a lever rotatably engaged to a pivot rod between the clip member and the slider member and the lever is configured to releasably engage an end of the shield inserted in the open cavity and hold it therein.

The pivot mechanism wherein the track member comprises a second raised portion proximate to the first end comprising a cable guide, wherein the second surface of the slider member comprises a raised portion comprising a cable end detent;

wherein the pivot mechanism further comprises a cable configured to move within the cable guide and the cable end is held in the cable end detent, wherein when the cable is advanced distally from the cable guide the clamp is moved toward the second position, and when the cable is retracted proximally toward the cable guide the clamp is moved toward the first position.

The pivot mechanism wherein when the clamp is at its first position and a shield attached thereto is at a raised position relative to a helmet comprising the pivot mechanism; and wherein the slider bar is at its second position, the clamp is at its second position and a shield attached thereto is at a lowered position relative to a helmet comprising the pivot mechanism.

The pivot mechanism wherein when the clamp is at its first position and a shield attached thereto is at a lowered position relative to a helmet comprising the pivot mechanism; and wherein the slider bar is at its second position, the clamp is at its second position and a shield attached thereto is at a raised position relative to a helmet comprising the pivot mechanism.

The pivot mechanism further comprising a cable movement mechanism remote from the pivot mechanism and in operable communication with the pivot mechanism via a cable, the cable movement mechanism comprising a first position and a second position; and a cable guide tube comprising a lumen in which the cable is movably contained, the cable guide tube running between the cable guide on the track member to a second cable guide associated with the cable movement mechanism, wherein the cable comprises a second cable end engaged with a second cable end detent on the cable movement mechanism; wherein the first position of the cable movement mechanism defines a position wherein the cable is retracted and the clamp is in its first position of the pivot mechanism and the second position of the cable movement mechanism defines a position wherein the cable is advanced and the clamp is in its second position of the pivot mechanism.

The pivot mechanism wherein the cable movement mechanism comprises a slider bar, wherein when the slider bar is moved distally from the second cable guide, the cable is retracted from the pivot mechanism and the clamp is moved toward the first position of the pivot mechanism; and wherein when the slider bar is moved proximally toward the second cable guide the cable is advanced in the pivot mechanism and the clamp is moved toward the second position of the pivot mechanism.

The pivot mechanism wherein when the slider bar is at its first position, the clamp is at its first position and a shield attached thereto is at a raised position relative to a helmet comprising the pivot mechanism; and wherein the slider bar is at its second position, the clamp is at its second position and a shield attached thereto is at a lowered position relative to a helmet comprising the pivot mechanism.

The pivot mechanism wherein when the slider bar is at its first position, the clamp is at its first position and a shield attached thereto is at a lowered position relative to a helmet comprising the pivot mechanism; and wherein the slider bar is at its second position, the clamp is at its second position and a shield attached thereto is at a raised position relative to a helmet comprising the pivot mechanism.

In another aspect, this disclosure provides a helmet comprising: a shell; a shield on said shell movable between a lowered position covering the eye region of a user wearing the helmet and a raised position displaced from said eye region; and a pivot mechanism as described above wherein an end of the shield is attached to the clamp.

Embodiments of the helmet include the following, alone or in any combination.

The helmet wherein the shield is in its raised position when the clamp of the pivot mechanism is in its first position and the shield is in its lowered position when the clamp of the pivot mechanism is in its second position.

The helmet wherein the shield is in its lowered position when the clamp of the pivot mechanism is in its first position and the shield is in its raised position when the clamp of the pivot mechanism is in its second position.

The helmet further comprising a mechanism in operational communication with the pivot mechanism to raise or lower the shield.

The helmet wherein the clamp comprises a passageway wherein at least a portion of the interior surface of the passageway slidingly engages at least a portion of the exterior surface of the curved track; and a recess configured to engage the end of the shield to attach the clamp thereto.

The helmet comprising an inner shield and an outer shield wherein the pivot mechanism is attached to the inner shield.

The helmet comprising an inner shield and an outer shield wherein the pivot mechanism is attached to the outer shield.

The helmet comprising an inner shield and an outer shield wherein a first pivot mechanism is attached to the inner shield and a second pivot mechanism is attached to the outer shield.

The helmet comprising a pivot mechanism comprising a track member comprising the curved track having the first end and the second end, an inside radius side, an outside radius side and a fixed width therebetween, a first raised portion proximate to the first end, and a second raised portion proximate to the second end; and a clamp comprising a clip member comprising a generally planar region having a first surface and an opposed second surface, and one or more raised portions on the first surface; and a slider member attached to the clip member, the slider member comprising a generally planar region having a first surface and a second surface, wherein the first surface of the clip member and the first surface of the slider member face each other and the generally planar region of the clip member and the generally planar region of the slider are spaced apart and substantially parallel, at least one first raised track engagement feature configured to slidably engage the inside radius side of the curved track, at least one second raised track engagement feature configured to slidably engage the outside radius side of the curved track, wherein a first portion of the generally planar region of the clip member, a first portion the generally planar region of the slider member, first raised track engagement feature, and the second raised track engagement feature define a passageway slidingly engaged around the curved track, and a second portion of the generally planar region of the clip member, and a second portion the generally planar region of the slider member define an open cavity for insertion of an end of the shield, and when a first portion of the clamp is in contact with the first raised portion of the track member, they define a first position of the clamp and when a second portion of the clamp is in contact with the second raised portion of the track member, they define a second position of the clamp.

The helmet further comprising a cable movement mechanism remote from the pivot mechanism and in operable communication with the pivot mechanism via a cable, the cable movement mechanism comprising a first position and a second position; and a cable guide tube comprising a lumen in which the cable is movably contained, the cable guide tube running between the cable guide on the track member to a second cable guide associated with the cable movement mechanism, wherein the cable comprises a second cable end engaged with a second cable end detent on the cable movement mechanism; wherein the first position of the cable movement mechanism defines a position wherein the cable is retracted and the clamp is in its first position of the pivot mechanism and the second position of the cable movement mechanism defines a position wherein the cable is advanced and the clamp is in its second position of the pivot mechanism.

The helmet wherein the cable movement mechanism comprises a slider bar, wherein when the slider bar is moved distally from the second cable guide, the cable is retracted from the pivot mechanism and the clamp is moved toward the first position of the pivot mechanism; and wherein when the slider bar is moved proximally toward the second cable guide the cable is advanced in the pivot mechanism and the clamp is moved toward the second position of the pivot mechanism.

The helmet wherein when the slider bar is at its first position, the clamp is at its first position and the shield attached thereto is at a raised position; and wherein when the slider bar is at its second position, the clamp is at its second position and the shield attached thereto is at a lowered position.

The helmet wherein when the slider bar is at its first position, the clamp is at its first position and the shield attached thereto is at a lowered position; and wherein when the slider bar is at its second position, the clamp is at its second position and the shield attached thereto is at a raised position.

DETAILED DESCRIPTION

Figure 1:
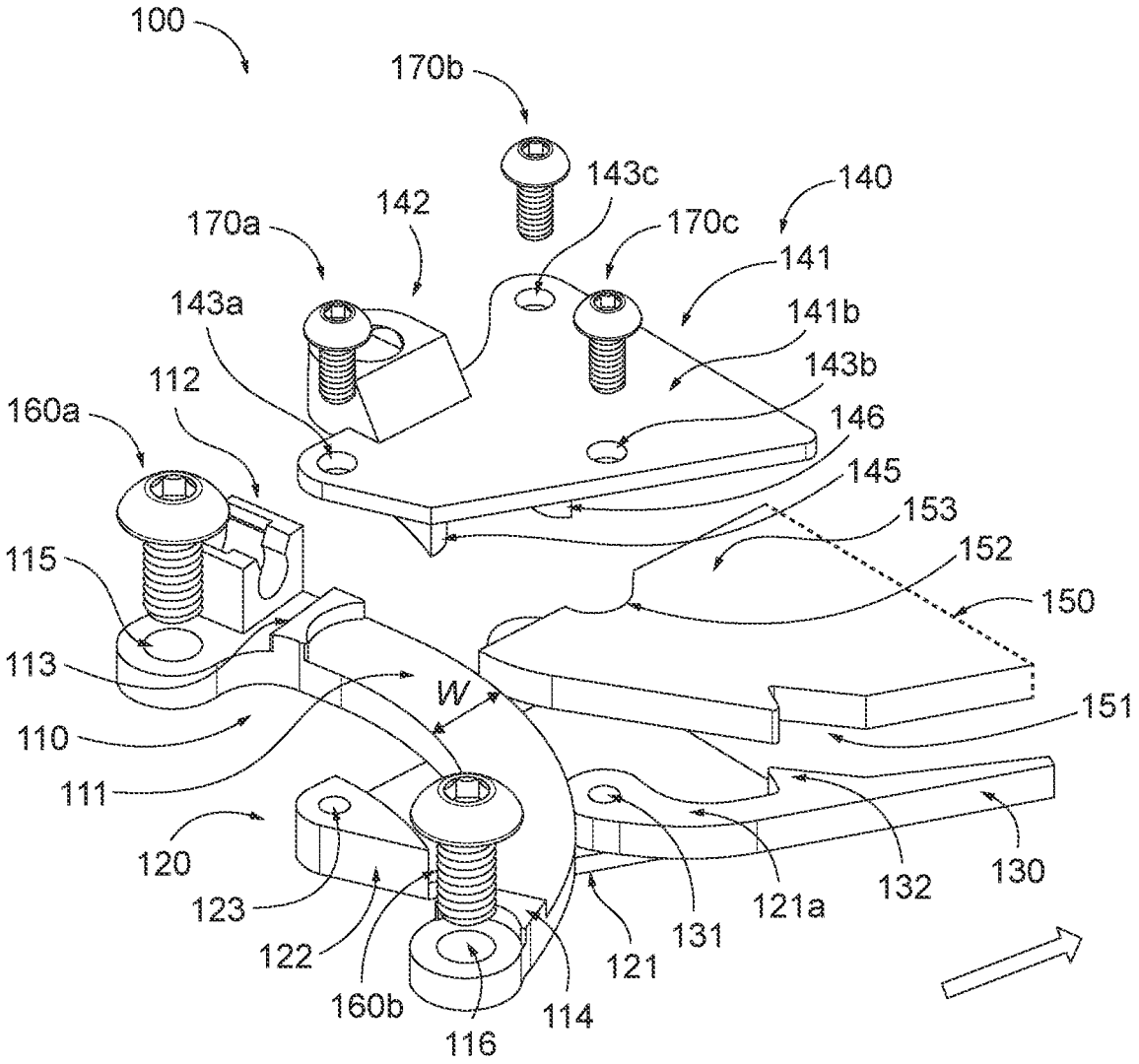
FIG. 1 shows an exploded view of a pivot mechanism according to an exemplary embodiment of the disclosed subject matter.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

Unless otherwise explicitly indicated, as used herein the terms "internal", "inner" and "inside" indicate a relative position towards the helmet portion which is or would be closer to the wearer's head. Unless otherwise explicitly indicated, as used herein the terms "exterior", "outer" and "external" indicate a relative position towards the helmet portion which is or would be closer to the outside of a helmet which is or would be away from the wearer's head. Similarly, terms such as "front", "rear", "side", "right", "left", "bottom", "top", "brow", "crown", and the like refer to portions of a helmet or mechanisms therein relative to the helmet as worn by a user of the helmet.

A helmet as described herein can be used for a cyclist, football player, hockey player, baseball player, lacrosse player, polo player, climber, auto racer, motorcycle rider, motocross racer, skier, snowboarder or other snow or water athlete, sky diver or any other athlete in a sport. Other industries also use protective headwear, such that individuals employed in other industries and work such as construction workers, soldiers, fire fighters, pilots, or types of work and activities can also use or be in need of a safety helmet, where similar technologies and methods can also be applied. Each of the above listed sports, occupations, or activities can use a protective helmet that comprises an outer shell and an inner energy-absorbing or energy management material and a shield for shielding the wearer's eyes or face. For convenience, protective helmets can be generally classified as either in-molded helmets or hard shell helmets. In-molded helmets can comprise one layer, or more than one layer, including a thin outer shell, an energy-absorbing layer or impact liner, and a comfort liner or fit liner. Hard-shell helmets can comprise a hard outer shell, an impact liner, and a comfort liner. The hard outer shell can be formed by injection molding and can include Acrylonitrile-Butadiene-Styrene (ABS) plastics or other similar or suitable material. The outer shell for hard-shell helmets is typically made hard enough to resist impacts and punctures, and to meet the related safety testing standards, while being flexible enough to deform slightly during impacts to absorb energy through deformation, thereby contributing to energy management. Hard-shell helmets can be used as skate bucket helmets, motorcycle helmets, snow and water sports helmets, football helmets, batting helmets, catcher's helmets, hockey helmets, and can be used for BMX riding and racing. While various aspects and implementations presented in the disclosure focus on embodiments comprising hard-shell helmets or helmets comprising an outer shell and a shield, the disclosure also relates and applies to other helmets, applications, and embodiments in which the principles and features discussed herein can be advantageously applied. As such, a helmet comprising a pivot mechanism as disclosed herein can be employed wherever a conventional helmet is used to take advantage of the additional benefits described herein.

This disclosure provides a pivot mechanism for a helmet or protective head gear that includes an outer shell and a protective shield such as a face shield or an eye shield, wherein the pivot mechanism provides for pivoting the shield between a raised position and a lowered position.

The pivot mechanism described herein provides a "virtual pivot point" for the shield. The pivot point for the shield is not a physical structure located at the shield's axis of rotation, but articulation of the shield is achieved by moving a clamp along a curved track with a radius of curvature centered at the pivot point.

The disclosed pivot mechanism results in a reduced overall size and reduced footprint compared to previous hingeplates. The disclosed pivot mechanism may also be less complex and have fewer parts than conventional hingeplates. The virtual pivot can also reduce mechanism stack-up wherein multiple pivot mechanisms take up a lot of volume for potential impact material due to their need for concentric axes of operation.

The pivot mechanism comprises a curved track having a first end and a second end; and a clamp slidingly engaged to the curved track, wherein the clamp is configured to attach to an end of the shield and slide along the track between a first position proximate to the first end of the curved track and a second position proximate to the second end of the curved track. In an embodiment of the pivot mechanism, the clamp comprises a passageway wherein at least a portion of the interior surface of the passageway slidingly engages at least a portion of the exterior surface of the curved track; and a recess configured to engage the end of the shield to attach the clamp thereto.

One of skill in the art can appreciate that helmets have a high degree of bilateral symmetry wherein the sides of the helmet are substantially mirror images of each other. Shields on helmets typically protect the wearer's face and wrap around both sides of the helmet to pivot points or fulcrums about which the shield articulates between raised and lowered positions. One can also appreciate that a helmet may comprises a pair of pivot mechanisms described herein in which each of the pivot mechanisms engage an end of the shield, wherein the pivot mechanisms are substantially similar mirror images of each other. A helmet may, but does not necessarily, comprise a pair of such pivot mechanisms with a shield therebetween. Further, a dual shield helmet may, but does not necessarily, comprise a pair of such pivot mechanisms engaged with each shield. For simplicity of presentation, a single pivot mechanism is described and shown in the figures herein.

The following figures depict a specific embodiment of the pivot mechanism. For ease of presentation, an open arrow in the Figures indicates the direction to the front of a helmet containing the pivot mechanism. In FIGS. 1-6, the pivot mechanism and parts thereof are depicted as viewed from the inside of the helmet toward the left side of the helmet.

The pivot mechanism can comprise plastic or metal parts. For example, the track member, clip member and slider member as described herein may be molded from plastic, notably acetal or polyoxymethylene (POM), which is, for example, commercially available under the DELRIN® tradename. Parts such as screws and cables may be fabricated from metal.

FIG. 1 shows an exploded view of a specific pivot mechanism according to an exemplary embodiment of the disclosed subject matter. The pivot mechanism 100 comprises a track member 110 comprising curved track 111 having a first end and a second end, an inside radius side, an outside radius side with a fixed width w therebetween, a first raised portion 113 proximate to the first end, and a second raised portion 114 proximate to the second end. Proximate to the first end and the second end are screw through-holes 115 and 116 respectively. Screws 160*a* and 160*b* pass through holes 115 and 116 respectively to fasten the trach member 110 to the inside of the outer shell of a helmet (not shown). Also proximate to the first end is a an additional raised portion 112 that comprises a cable guide for a cable (not shown) that actuates the pivot mechanism 100 to raise or lower an attached shield.

The pivot mechanism 100 also comprises a clamp that comprises a clip member 120 and a slider member 140. The clip member 120 comprises a generally planar region 121 having a first surface 121*a* and an opposed second surface (not shown), and one or more raised portions 122 and 125 (see FIG. 5) on the first surface 121*a*.

The slider member 140 comprises a generally planar region 141 having a first surface (see 141*a* in FIG. 3) and a second surface 141*b*, wherein the first surface 121*a* of the clip member 120 and the first surface 141*a* of the slider member 140 face each other and the generally planar region 121 of the clip member 120 and the generally planar region 141 of the slider member 140 are spaced apart and substantially parallel. The slider member comprises at least one first raised track engagement feature 145 configured to slidably engage the inside radius side of the curved track and at least one second raised track engagement feature 146 configured to slidably engage the outside radius side of the curved track 111. The track engagement features 145 and 146 are spaced apart by a distance essentially equal to the width w of track member 111 so that the track engagement features can contact and slide along the respective inside and outside radius sides of the track 111. Slider member 140 also comprises a raised portion 142 comprising a cable end detent.

The clip member 120 and slider member 140 are attached together using screws 170*a*, 170*b* and 170*c* that pass through holes 143*a*, 143*b* and 143*c*, respectively and are anchored in screw sockets 123 and 126 and a third screw socket (not shown). Use of screws to attach the pivot mechanism 100 to the outer shell of the helmet and to attach the clip member 120 to the slider member 140 is not limiting and alternatively other mechanical fasteners, or adhesives, can be used.

A shield end 150 is shown engaged with the pivot mechanism 100 disposed between clip member 120 and slider member 140, wherein the rest of the shield extends beyond the dashed line and is not shown for simplicity of presentation. As discussed above, a shield would typically wrap around the front of the helmet and the opposite end of the shield would engage with a second pivot mechanism, which is substantially a mirror image of the pivot mechanism shown in FIG. 1.

In embodiments, the shield is designed to be replaceable by the user, such that it may be easily removed and replaced with another shield with differing properties, (e.g., a lighter or darker tint, different color, etc.) or with another shield with the same properties (e.g., if the original shield is damaged, etc.). In such embodiments, the replacement of the shield may employ merely simple, common tools, or even no tools at all. In embodiments, the pivot mechanism may comprise a lever rotatably engaged to a pivot rod between the clip member and the slider member and the lever is configured to releasably engage an end of the shield inserted in the open cavity and hold it therein. In the embodiment shown in FIG. 1, a lever 130 is disposed between clip member 120 and slider member 140 and pivot hole 131 is engaged around screw 170*c* so that screw 170*c* functions as a pivot rod or fulcrum for lever 130 to pivot or rotate around. Use of a screw as a pivot rod for lever 130 is not limiting, and other pivots such rods or dowels are envisioned. Lever 130 comprises an edge with a shape configured to engage a complementary edge on shield end 150 and hold it in place in the pivot mechanism 100. In the embodiment shown, projection 132 on lever 130 engages notch 151 on shield end 150, but this is not limiting and other complementary shapes are envisioned. Rotating lever 130 about the pivot defined by pivot hole 131 disengages projection 132 and notch 151, allowing shield end 150 to be disengaged from pivot mechanism 100.

Figure 2:
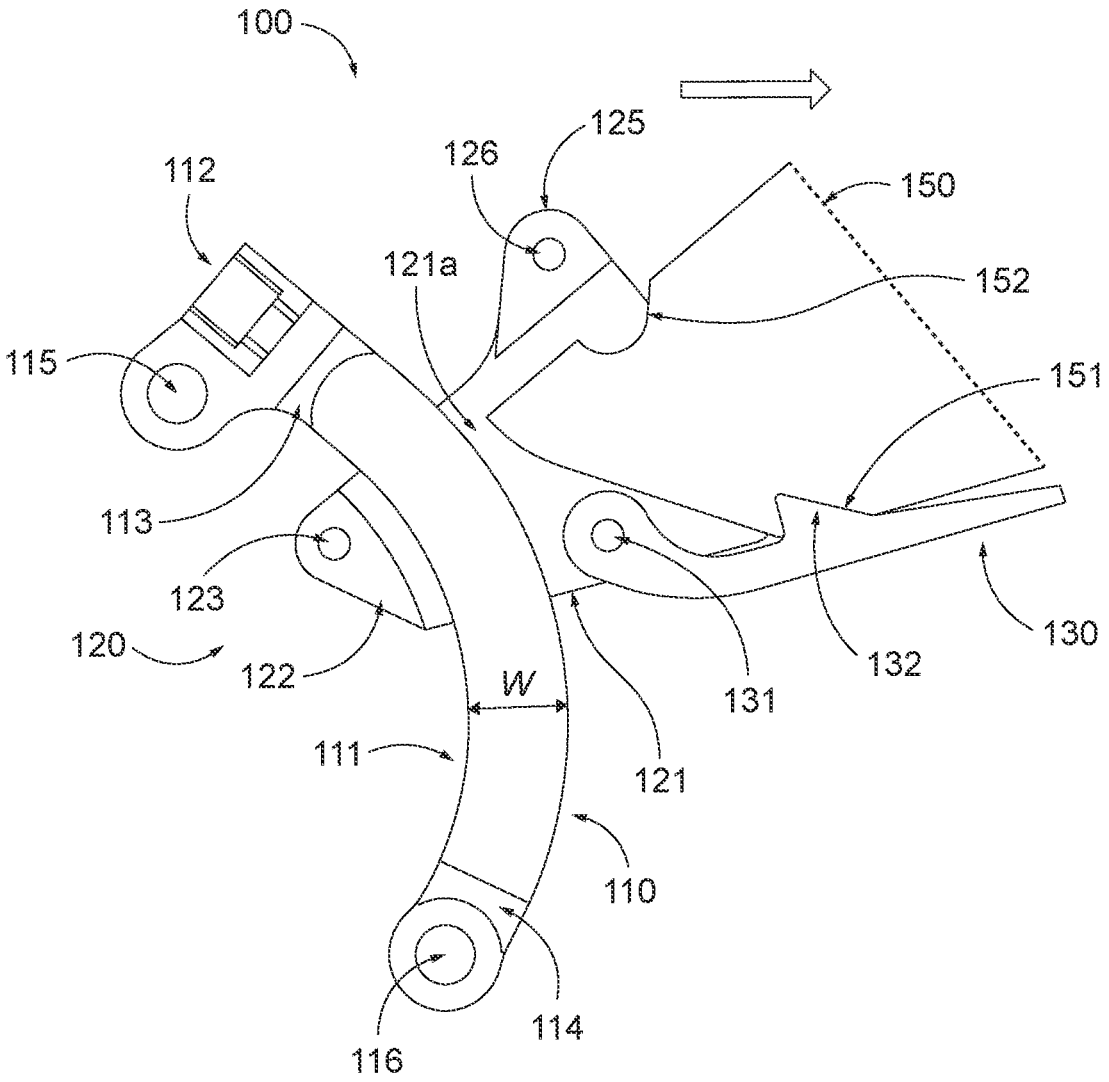
FIG. 2 shows an elevation view of the track member, the clip member and shield end of the pivot mechanism of FIG. 1, according to an exemplary embodiment of the disclosed subject matter.

FIG. 2 shows an elevation view of the track member 110, clip member 120, lever 130 and shield end 150 with slider member 140 removed to show the features of the track member 110, clip member 120, lever 130 and shield end 150 that were partially or fully obscured by slider member 140 in FIG. 1.

Figure 3:
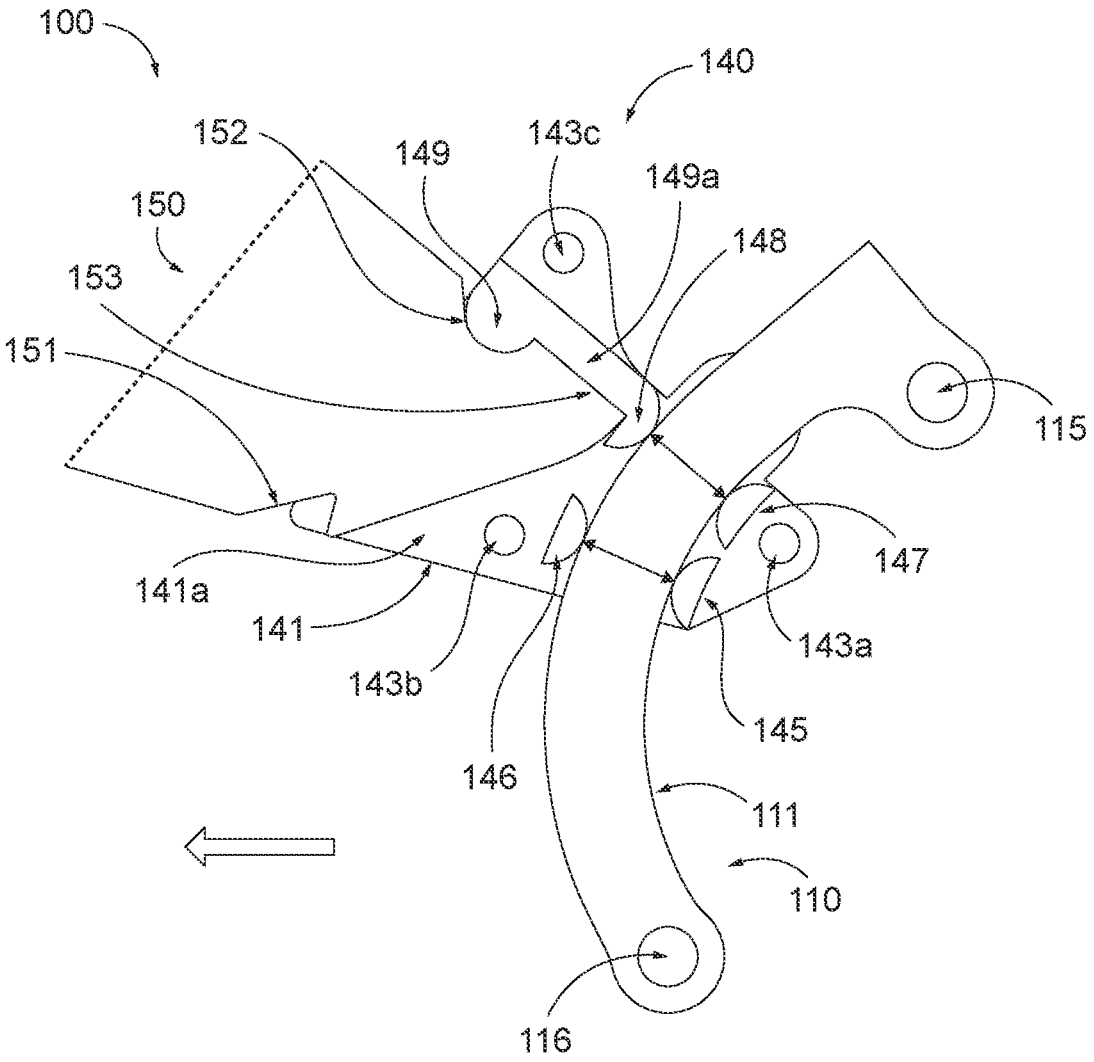
FIG. 3 shows an elevation view of the track member, slider member and shield end of the pivot mechanism of FIG. 1, according to an exemplary embodiment of the disclosed subject matter.

FIG. 3 shows the pivot mechanism 100 flipped over and with the clip member 120 and lever 130 removed to show features of the track member 110 and slider member 140 that were not visible in FIG. 1. First and second track engagement features 145 and 146 are shown separated by distance w so that portions thereof contact the sides of track 111. An additional set of track engagement features 147 and 148 are also shown, also separated by distance w. These track engagement features are shown as raised projections above first surface 141*a* with curved faces to minimize the amount of contact and friction with the track 111, but this is not limiting. Other track engagement features can be envisioned, such as wheels that contact the sides of track 111 and roll along the sides. As shown, raised projection 149 is connected to track engagement feature 148 by bar 149*a*, but this is not limiting. Projection 149 and bar 149*a* engage notch 152 and edge 153 of shield end 150 and help hold shield end 150 in the clamp.

Figure 4:
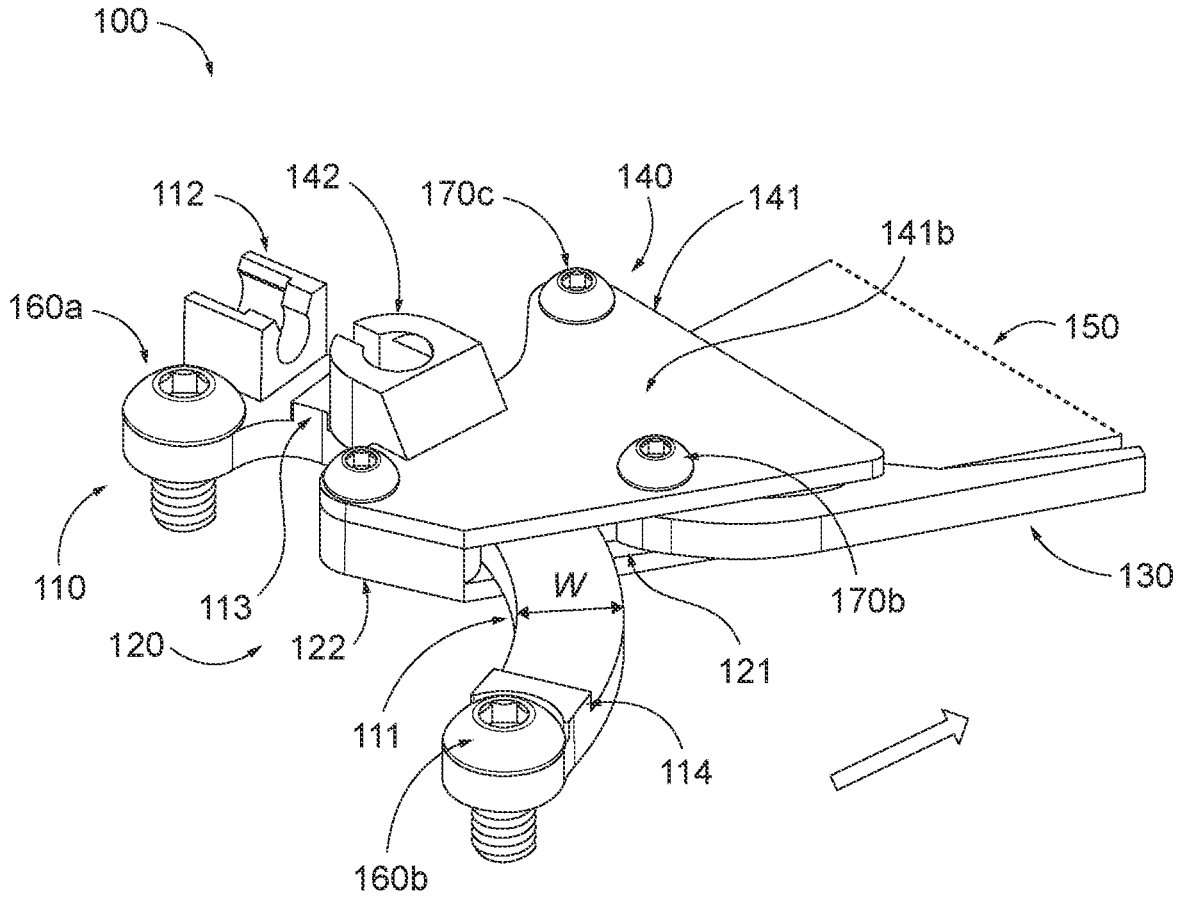
FIG. 4 shows an assembled view of the pivot mechanism of FIG. 1 according to an exemplary embodiment of the disclosed subject matter.

FIG. 4 show an assembled view of pivot mechanism 100, wherein clip member 120 and slider member 140 are attached together by screws 170*a*, 170*b* and 170*c*. Raised portions 122 and 125 on clip member 120 and track engagement features 145 and 146 have the same raised dimension above their respective first surfaces 121*a* and 141*a* such that they hold the planar portions 121 and 141 substantially parallel at a constant distance apart. Features 147, 148, 149 and 149*a* (see FIG. 3) have the same raised dimension. Track 111, lever 130 and shield end 150 have thicknesses that are essentially the same as the raised dimension of 122, 125 145 and 146. This distance is configured such that when the clip member 120 and slider member 140 are attached together as shown, a first portion of the generally planar region 121 of the clip member 120, a first portion the generally planar region 141 of the slider member 141, first raised track engagement feature 145, and second raised track engagement feature 146 define a passageway slidingly engaged around the curved track 111. A second portion of the generally planar region 121 of the clip member 120, a second portion of the generally planar region 141, and features 149 and 149*a*, of the slider member 140 define an open cavity for insertion of an end of the shield end 150.

Figure 5:
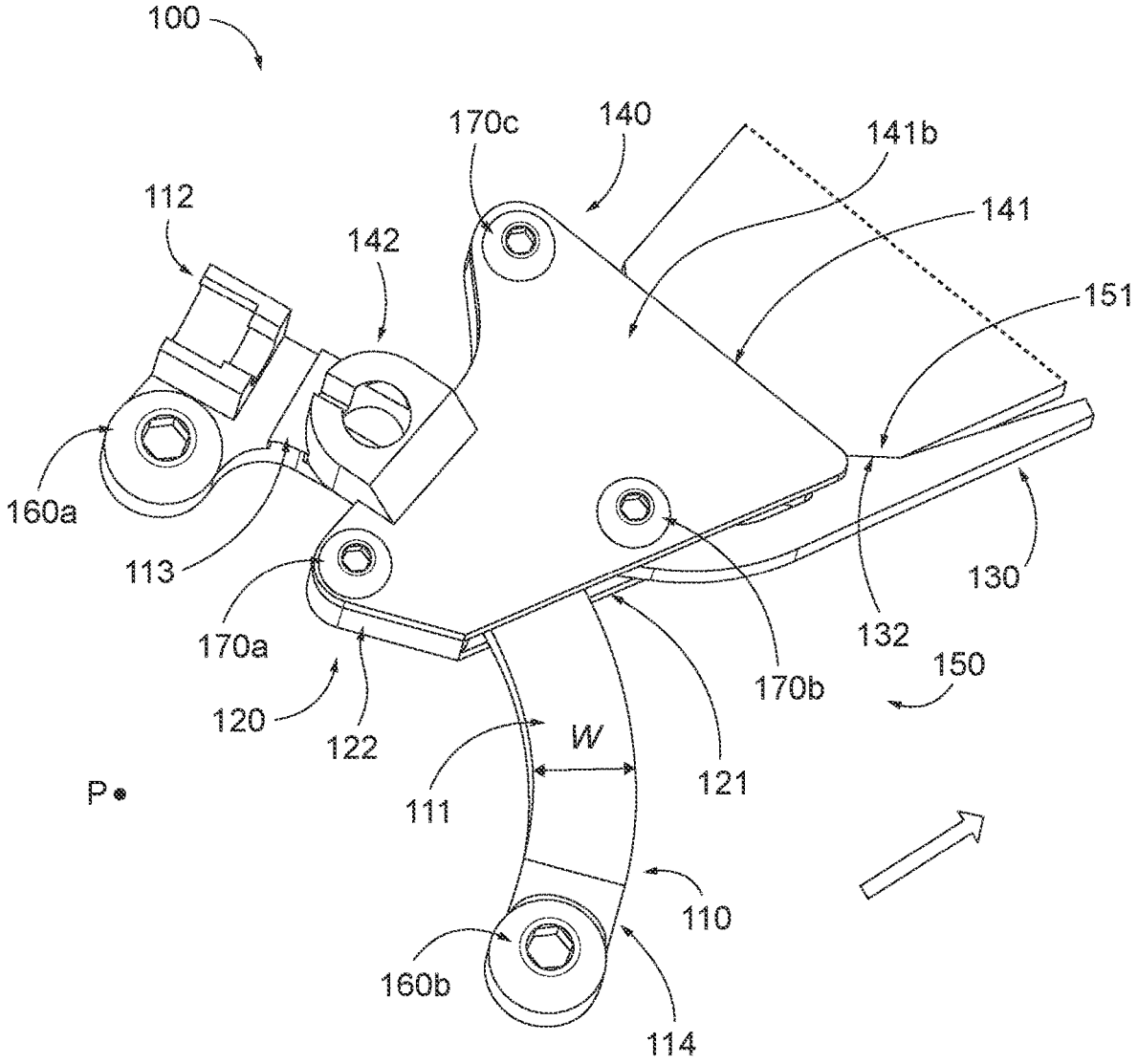
FIG. 5 shows a view of the pivot mechanism of FIG. 1 in a first, raised position, according to an exemplary embodiment of the disclosed subject matter.
Figure 6:
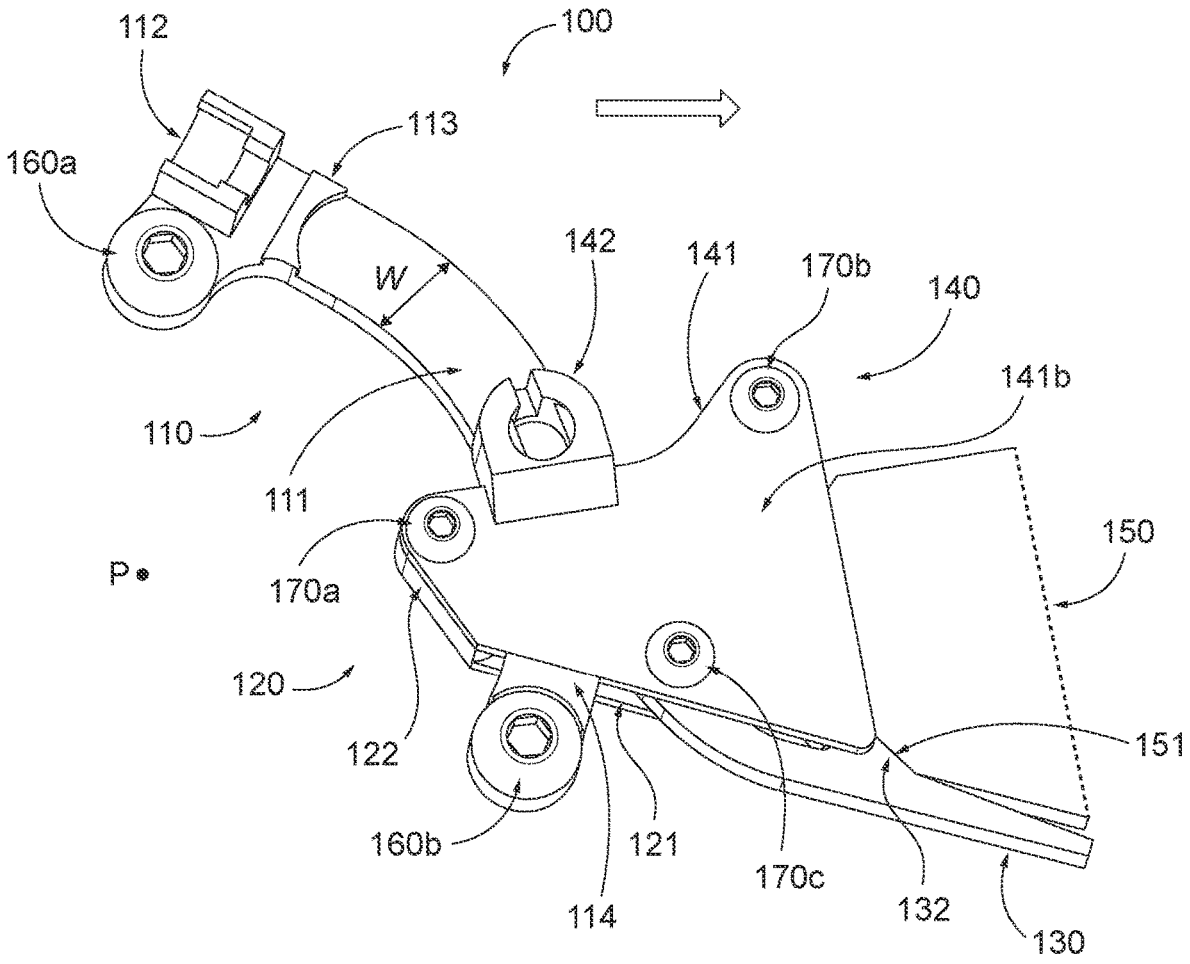
FIG. 6 shows a view of the pivot mechanism of FIG. 1 in a second, lowered position, according to an exemplary embodiment of the disclosed subject matter.

FIGS. 5 and 6 show the assembled pivot mechanism 100 wherein the clamp is in a first and second position respectively. These figures show that the clamp can slide along track 111 and move the engaged shield end 150 between the first and second positions. The figures also show the approximate position of the virtual pivot P, about which the clamp and engaged shield end pivots. As can be seen, no part of the pivot mechanism 100 occupies the locus of virtual pivot P.

In FIG. 5, when a first portion of the clamp (in this embodiment the edge of raised portion 142 of slider member 140) is in contact with the first raised portion 113 of the track member 110, they define a first position of the clamp and a shield engaged with the pivot mechanism 100 via shield end 150 is in a raised or open position wherein the shield is disposed within or proximate to the brow region of a helmet and does not shield the eyes or face of the wearer. In FIG. 6, when a second portion of the clamp (in this embodiment the edges of planar regions 121 and 141) the edge of raise portion is in contact with the second raised portion 114 of the track member 110, they define a first position of the clamp and a shield engaged with the pivot mechanism 100 via shield end 150 is in a lowered or closed position wherein the shield is disposed in front of the eyes or face shield of the wearer.

Notably, a pivot mechanism can be substantially the same as the pivot mechanism shown in FIGS. 1 through 6 that does not include the cable guide 112 and cable end detent 142.

In embodiments, the pivot mechanism further comprises a cable configured to move within the cable guide and the cable end is held in the cable end detent, wherein when the cable is advanced distally (see solid arrow A in FIG. 7A) from the cable guide the clamp is moved toward the second position, and when the cable is retracted proximally (see dashed arrow R in FIG. 7A) toward the cable guide the clamp is moved toward the first position.

In embodiments, the pivot mechanism further comprises a cable movement mechanism remote from the pivot mechanism and in operable communication with the pivot mechanism via the cable, the cable movement mechanism comprising a first position and a second position; and a cable guide tube comprising a lumen in which the cable is movably contained, the cable guide tube running between the cable guide on the track member to a second cable guide associated with the cable movement mechanism, wherein the cable comprises a second cable end engaged with a second cable end detent on the cable movement mechanism; wherein the first position of the cable movement mechanism defines a position wherein the cable is retracted and the clamp is in its first position of the pivot mechanism and the second position of the cable movement mechanism defines a position wherein the cable is advanced and the clamp is in its second position of the pivot mechanism.

An example of these embodiments is shown in FIGS. 7A, 7B, 7C, 8 and 9.

Figure 7A:
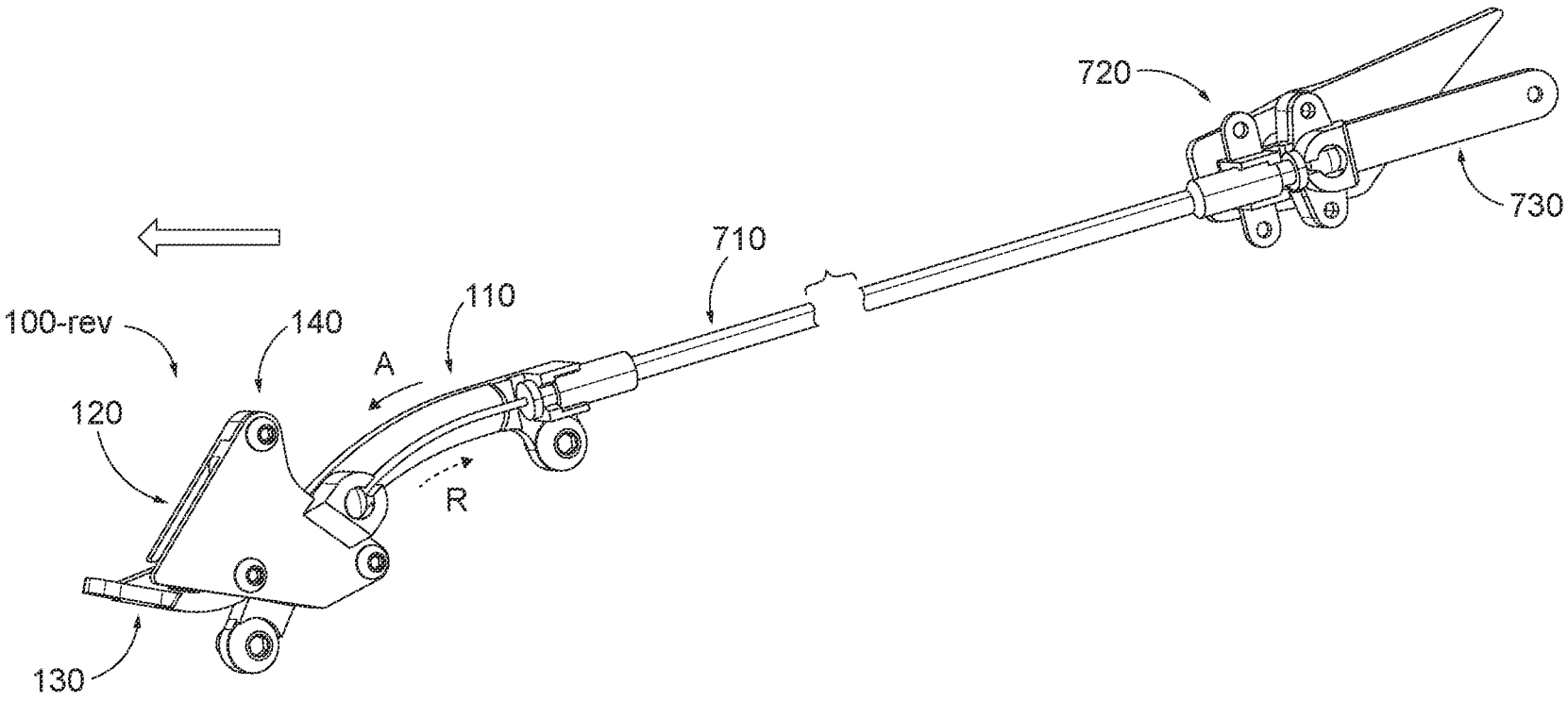
FIG. 7A shows a view of the pivot mechanism of FIG. 1 in operational communication with a cable movement mechanism, according to an exemplary embodiment of the disclosed subject matter.
Figure 7B:
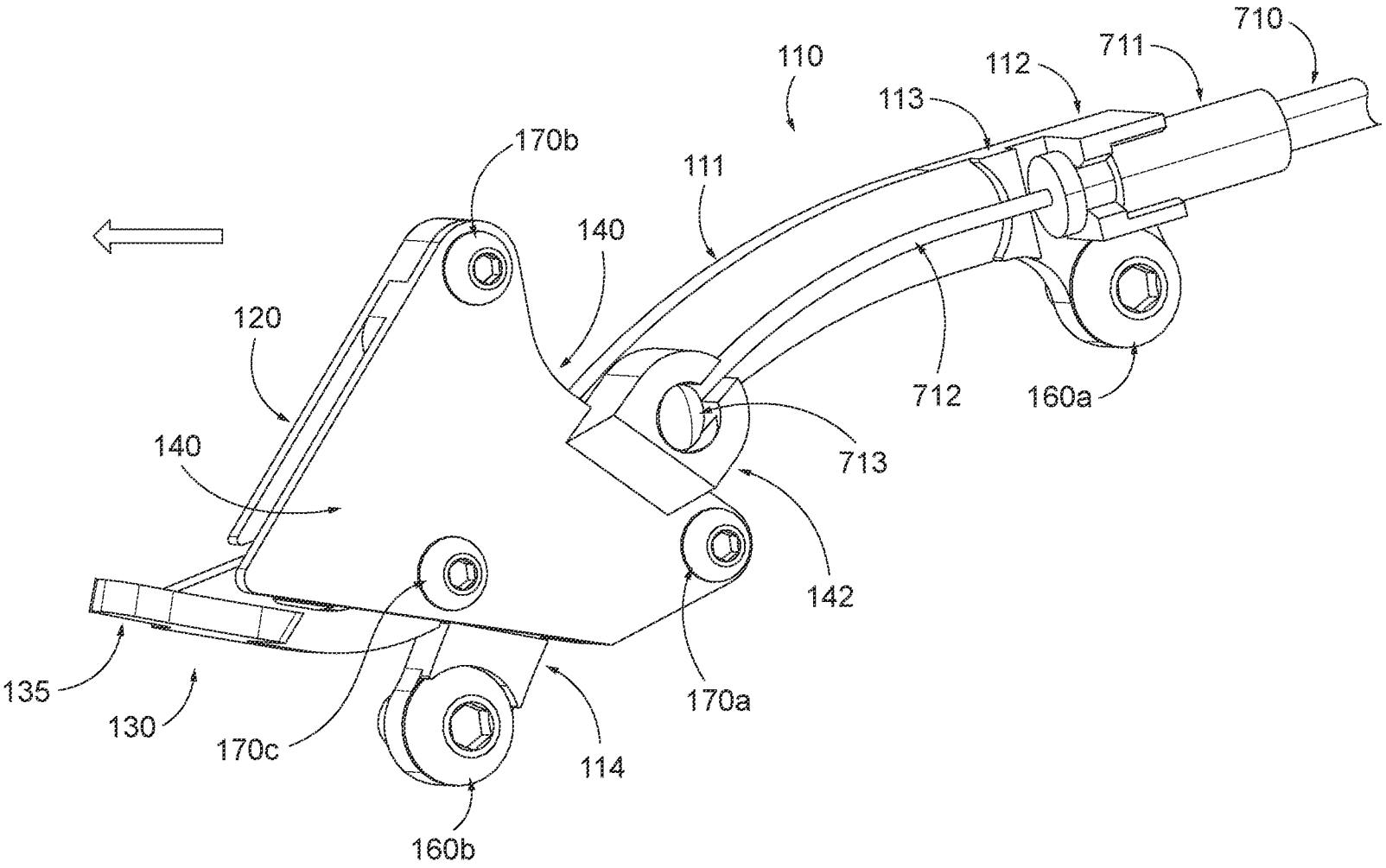
FIG. 7B shows a close-up view of the pivot mechanism of FIG. 7A, according to an exemplary embodiment of the disclosed subject matter.

FIG. 7A shows a pivot mechanism 100-rev in operational communication with a cable movement mechanism 720 via cable guide tube 710. The length and configuration of cable guide is dependent on the design of a helmet containing the pivot mechanism and the cable movement mechanism and is shown in FIG. 7A with the middle portion omitted for ease of presentation. Cable movement mechanism 720 is engaged with mount 730. The view of FIG. 7A is from the interior of a helmet incorporating the pivot mechanism toward the right side of the helmet. One can appreciate that this is the opposite of the views shown in FIGS. 1 through 6, so that each of the components of the pivot mechanism 100-rev is the mirror image of the pivot mechanism 100 shown in those figures. FIG. 7B shows a close-up view of the pivot mechanism 100-rev. For ease of presentation, the suffix "-rev" is omitted for components of the pivot mechanism 100-rev shown in FIGS. 7A and 7B that are mirror images of the components with the same reference number in pivot mechanism 100 shown in FIGS. 1 through 6.

In FIG. 7B, cable guide tube comprises a first cable guide ferrule 711 which engages cable guide 112. Cable 712 is contained within cable guide tube 710 and extends beyond cable guide ferrule 711 and first cable end 713 is engaged with cable end detent 142. FIG. 7B shows the cable 712 advanced distally from cable guide 112 such that the clamp is in its second position, wherein a shield (not shown) is in a lowered position. Flange 135 on lever 130 provides a grip to facilitate a user manipulating lever 130 to engage or disengage a shield end (not shown).

Figure 7C:
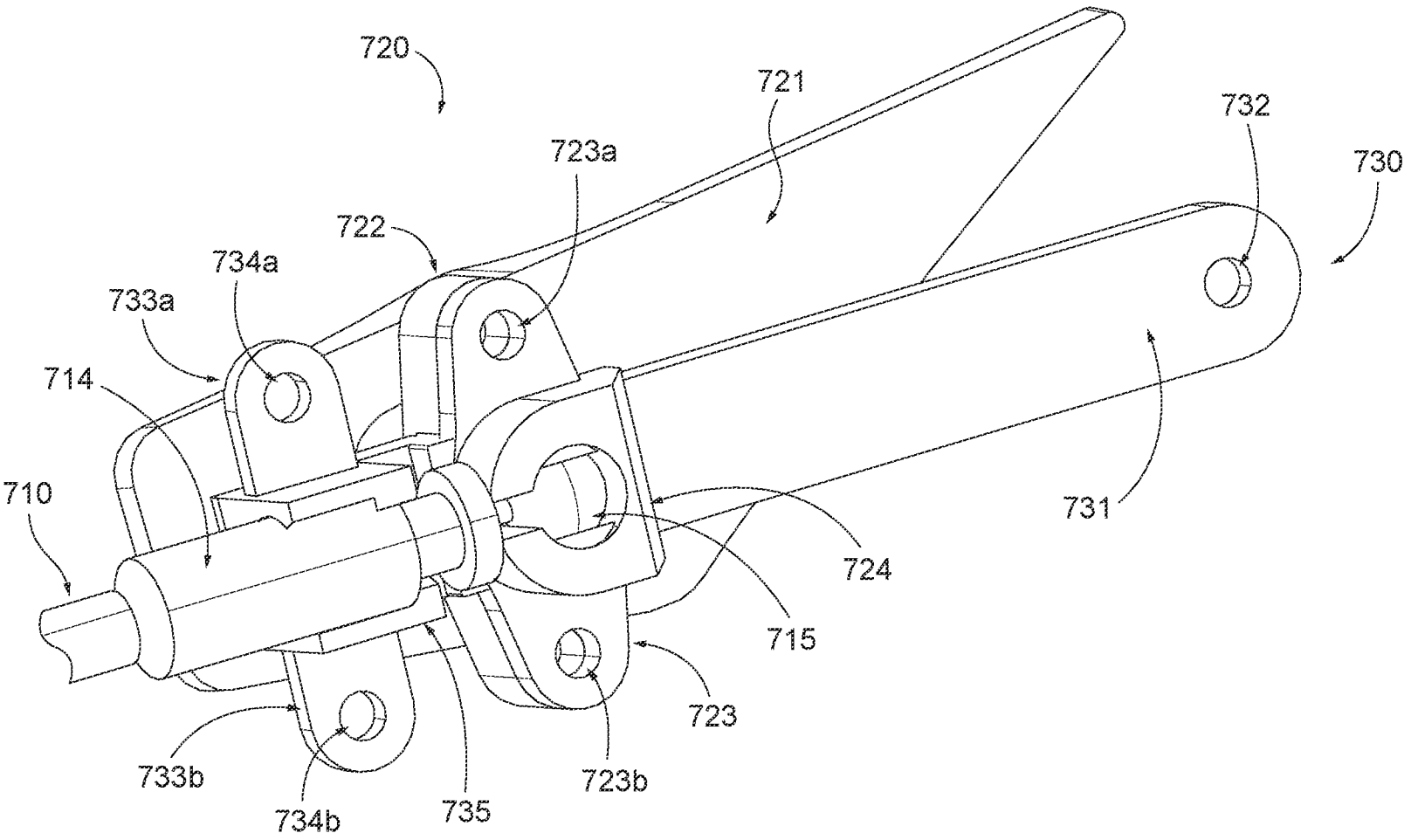
FIG. 7C shows a close-up view of the cable movement mechanism of FIG. 7A, according to an exemplary embodiment of the disclosed subject matter.

FIG. 7C depicts a close-up view of the cable movement mechanism 720 and mount 730. Mount 730 comprises a generally planar strip 731 with a screw hole 732 proximate to its first end and opposed tabs 733*a* and 733*b* proximate to its second end. Also proximate to the second end is a cable guide 735 that engages a second cable guide tube ferrule 714. Mount 730 can be attached to the inside surface of an outer shell of a helmet on its right side (not shown) using fasteners such as screws (not shown) passing through holes 732, 734*a* and 734*b*. Alternatively, fastening by mechanical fasteners other than screws, or by adhesives, can also be envisioned.

Figure 8:
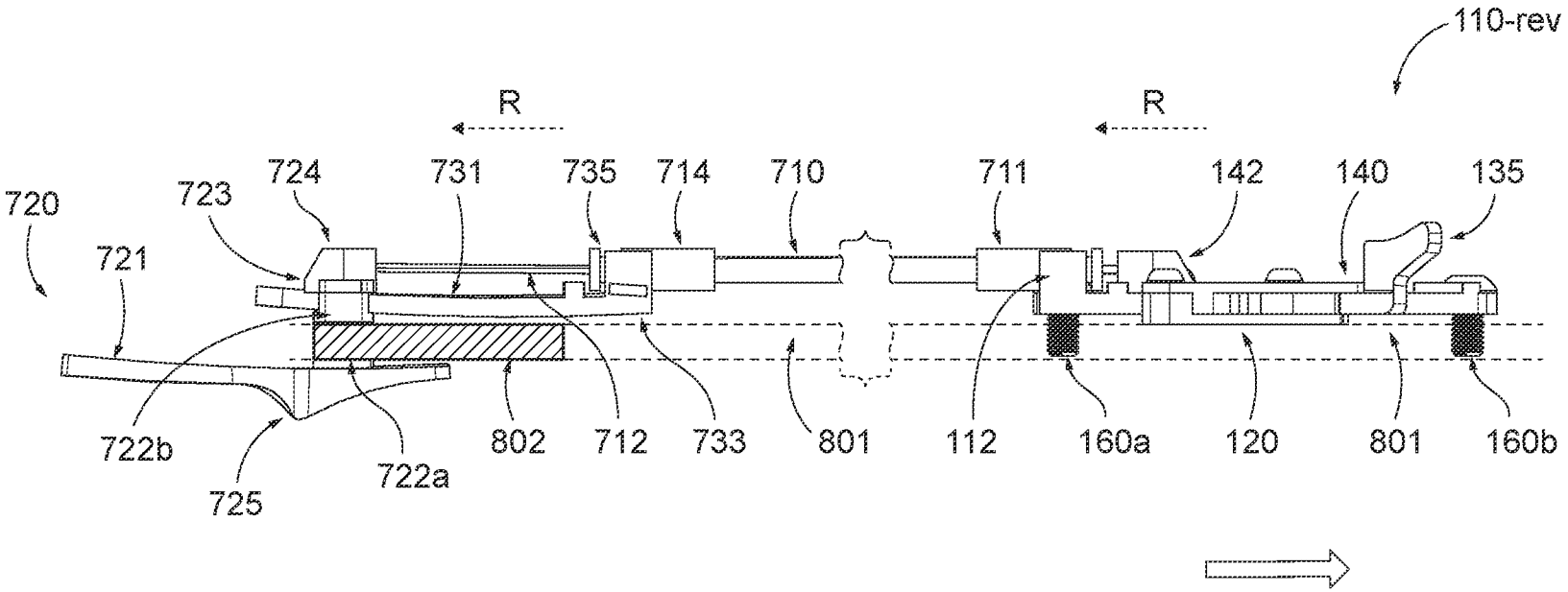
FIG. 8 shows a bottom view of the pivot mechanism and the cable movement mechanism, according to an exemplary embodiment of the disclosed subject matter.
Figure 9:
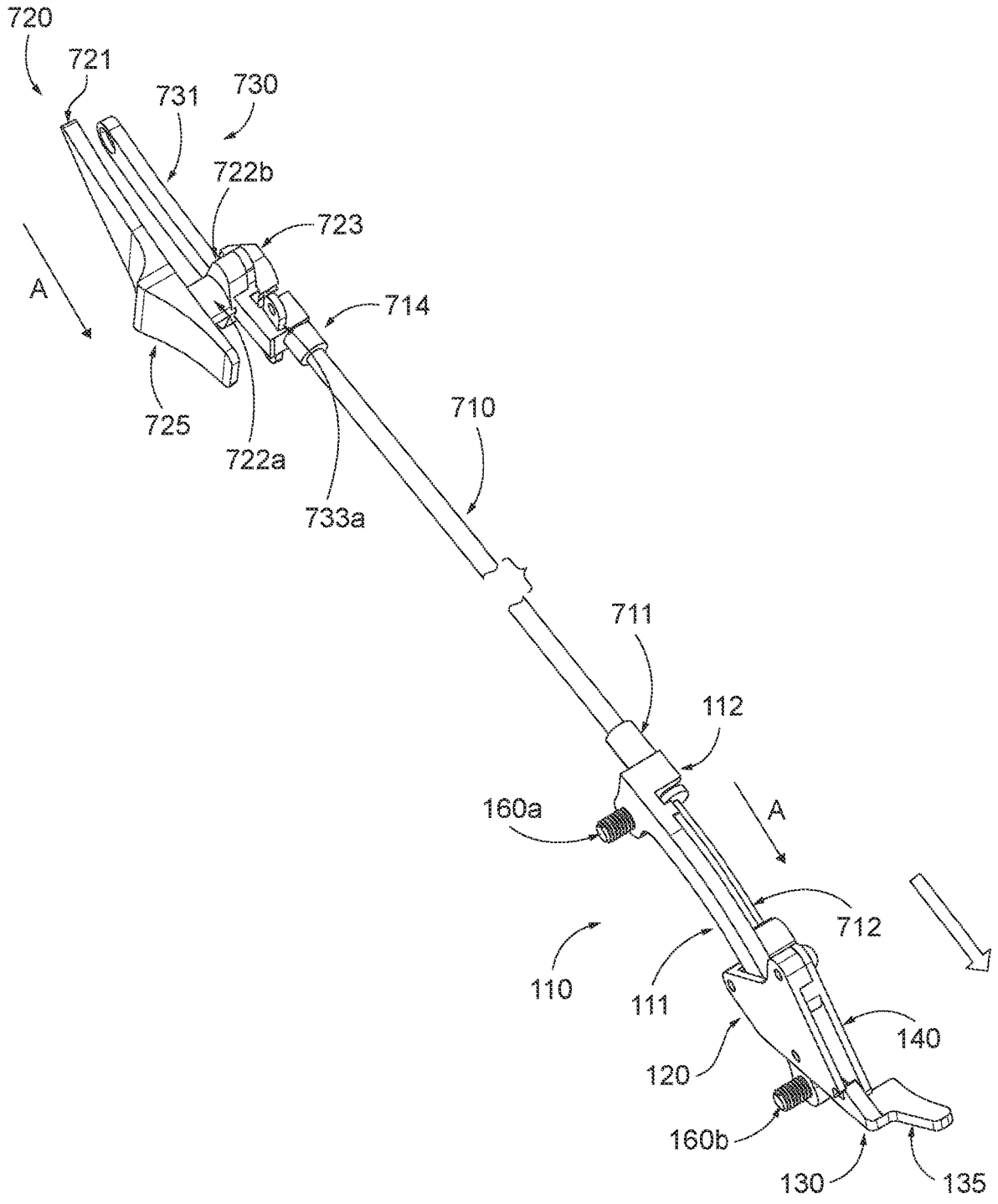
FIG. 9 shows a perspective view from the outside right front of a helmet of the pivot mechanism and the cable movement mechanism, according to an exemplary embodiment of the disclosed subject matter.

Cable movement mechanism 720 comprises a slider bar 721 comprising a raised clamp base 722 comprising a post 722*a* and extensions 722*b* and 722*c* (see FIGS. 8 and 9). Post 722*a* has a height slightly greater than the thickness of the outer shell and a diameter slightly smaller than a slot (see 802 in FIG. 8) in the outer shell such that the post 722*a* can slidingly move in the slot 802. The slider bar 721 slidingly engage the outside surface of the outer shell and extensions 722*a* and 722*b* slidingly engage the inside surface of the outer shell. Clamp cap 723 is attached to clamp base 722 by screws (not shown) through holes 723*a* and 723*b* such that clamp base 722 and clamp cap 723 define a passageway around strip 731 such that cable movement mechanism is slidingly engaged with mount 730 between a first position to the first end of strip 731 and a second position proximate to the second end of strip 731. Alternatively, fastening by mechanical fasteners other than screws, or by adhesives, can also be envisioned. Clamp cap 723 also comprises cable end detent 724 that engages second cable end 715 where cable 712 extends beyond second cable guide ferrule 714.

FIG. 8 shows a bottom view of the pivot mechanism 100-rev, the cable movement mechanism 720 and mount 730. The position of the outer shell 801 is shown by dashed lines, wherein the outer shell is disposed between the cable movement mechanism 720 and mount 730. Pivot mechanism 100-rev is shown mounted inside the outer shell 801. The hatched region shows the location of slot 802 that post 722*a* passes through. Projection 725 on slider bar 721 provides a grip that facilitates a user sliding the slider bar 721 between first and second positions along mount strip 731. Desirably, the slider bar and grip 725 are configured to be operable by a user wearing gloves. Cable movement mechanism 720, comprising slider bar 721 and cable end detent 724, is shown in a first position proximate to a first end of strip 731. In this first position cable 712 is fully retracted in the direction denoted by dotted arrow R because second cable end 715 is held by cable end detent 724 as slider bar 721 is moved in the direction R to the first position. Retraction of cable 712 in the direction R causes the clamp of pivot mechanism 110-rev, comprising clip member 120 and slider member 140, to move into its first position where cable end detent 142 is in contact with raised portion 113 of track member 110 (see FIG. 4). When slider bar 721 and the clamp are in their first positions, a shield end engaged in the clamp is disposed in a raised position so that the shield is disposed in a raised or open position and the shield is not in front of the wearer's eyes or face.

The outer shell 801 can be made of a flexible, semi-flexible, or rigid material, and can comprise plastics, including polycarbonate (PC), polyethylene terephthalate (PET), acrylonitrile butadiene styrene (ABS), polyethylene (PE), polyvinyl chloride (PVC), vinyl nitrile (VN), as well as resin, fiber, fiberglass, carbon fiber, Kevlar, or other suitable material. The outer shell 1001 can be stamped, in-molded, injection molded, vacuum formed, or formed by another suitable process. The outer shell 801 can also provide a smooth aerodynamic finish, a decorative finish, or both, for improved performance, improved aesthetics, or both. As a non-limiting example, the outer shell 801 can be ABS that is formed by injection molding.

FIG. 9 shows a perspective view of the pivot mechanism 100-rev, the cable movement mechanism 720 and mount 730 from the outside top right of a helmet incorporating them. Cable movement mechanism 720, comprising slider bar 721 and cable end detent 724, is shown in a second position proximate to the second end of strip 731. In this first position cable 712 is fully advanced in the direction denoted by solid arrow A because second cable end 715 is held by cable end detent 724 as slider bar 721 is moved in the direction A to the second position. Advance of cable 712 in the direction A causes the clamp of pivot mechanism 110-rev, comprising clip member 120 and slider member 140, to move into its second position where a portion of the bottom edge of the clamp is in contact with raised portion 114 of track member 110 (see FIG. 4 and FIG. 7B). When slider bar 721 and the clamp are in their second positions, a shield end engaged in the clamp is disposed in a lowered position so that the shield is disposed in a lowered or closed position and the shield is in front of the wearer's eyes or face.

As discussed above, a helmet may comprise two pivot mechanisms disclosed herein with a shield therebetween. One can appreciate that a first of the two pivot mechanisms may comprise a curved track having a first end and a second end; and a clamp slidingly engaged to the curved track, wherein the clamp is configured to attach to an end of the shield and slide along the track between a first position proximate to the first end of the curved track and a second position proximate to the second end of the curved track, such as wherein the clamp comprises a passageway wherein at least a portion of the interior surface of the passageway slidingly engages at least a portion of the exterior surface of the curved track; and a recess configured to engage the end of the shield to attach the clamp thereto.

A specific embodiment of the first pivot mechanism comprises (a) a track member comprising the curved track having the first end and the second end, an inside radius side, an outside radius side and a fixed width therebetween, a first raised portion proximate to the first end, and a second raised portion proximate to the second end; and (b) a clamp comprising (i) a clip member comprising a generally planar region having a first surface and an opposed second surface, and one or more raised portions on the first surface; and (ii) a slider member attached to the clip member, the slider member comprising a generally planar region having a first surface and a second surface, wherein the first surface of the clip member and the first surface of the slider member face each other and the generally planar region of the clip member and the generally planar region of the slider are spaced apart and substantially parallel, at least one first raised track engagement feature configured to slidably engage the inside radius side of the curved track, at least one second raised track engagement feature configured to slidably engage the outside radius side of the curved track, wherein a first portion of the generally planar region of the clip member, a first portion the generally planar region of the slider member, first raised track engagement feature, and the second raised track engagement feature define a passageway slidingly engaged around the curved track, and a second portion of the generally planar region of the clip member, and a second portion the generally planar region of the slider member define an open cavity for insertion of an end of the shield, and when a first portion of the clamp is in contact with the first raised portion of the track member, they define a first position of the clamp and when a second portion of the clamp is in contact with the second raised portion of the track member, they define a second position of the clamp.

The second pivot mechanism of the two pivot mechanism may be a mirror image of the first pivot mechanism, further comprising features that provide operational communication with a control mechanism to raise or lower a shield engaged to the pivot mechanism.

A specific embodiment of the second pivot mechanism comprises (a) a track member comprising the curved track having the first end and the second end, an inside radius side, an outside radius side and a fixed width therebetween, a first raised portion proximate to the first end, and a second raised portion proximate to the second end; and (b) a clamp comprising (i) a clip member comprising a generally planar region having a first surface and an opposed second surface, and one or more raised portions on the first surface; and (ii) a slider member attached to the clip member, the slider member comprising a generally planar region having a first surface and a second surface, wherein the first surface of the clip member and the first surface of the slider member face each other and the generally planar region of the clip member and the generally planar region of the slider are spaced apart and substantially parallel, at least one first raised track engagement feature configured to slidably engage the inside radius side of the curved track, at least one second raised track engagement feature configured to slidably engage the outside radius side of the curved track, wherein a first portion of the generally planar region of the clip member, a first portion the generally planar region of the slider member, first raised track engagement feature, and the second raised track engagement feature define a passageway slidingly engaged around the curved track, and a second portion of the generally planar region of the clip member, and a second portion the generally planar region of the slider member define an open cavity for insertion of an end of the shield, and when a first portion of the clamp is in contact with the first raised portion of the track member, they define a first position of the clamp and when a second portion of the clamp is in contact with the second raised portion of the track member, they define a second position of the clamp and wherein the track member comprises a second raised portion proximate to the first end comprising a cable guide, and wherein the second surface of the slider member comprises a raised portion comprising a cable end detent; wherein the pivot mechanism further comprises a cable configured to move within the cable guide and the cable end is held in the cable end detent, wherein when the cable is advanced distally from the cable guide the clamp is moved toward the second position, and when the cable is retracted proximally toward the cable guide the clamp is moved toward the first position.

This specific embodiment of the second pivot mechanism can be in operational communication with a control mechanism remote from the pivot mechanism such as cable movement mechanism in operational communication with the pivot mechanism via a cable movably contained in a cable guide tube running between the cable guide on the track member to a second cable guide associated with the cable movement mechanism, wherein the cable comprises a second cable end engaged with a second cable end detent on the cable movement mechanism, the cable movement mechanism comprising a first position and a second position; wherein the first position of the cable movement mechanism defines a position wherein the cable is retracted and the clamp is in its first position of the pivot mechanism and the second position of the cable movement mechanism defines a position wherein the cable is advanced and the clamp is in its second position of the pivot mechanism.

In an embodiment, the cable movement mechanism comprises a slider bar, wherein when the slider bar is moved distally from the second cable guide, the cable is retracted from the pivot mechanism and the clamp is moved toward the first position of the pivot mechanism; and wherein when the slider bar is moved proximally toward the second cable guide the cable is advanced in the pivot mechanism and the clamp is moved toward the second position of the pivot mechanism. When the slider bar is at its first position, the clamp is at its first position and a shield attached thereto is at a raised position relative to a helmet comprising the pivot mechanism; and wherein the slider bar is at its second position, the clamp is at its second position and a shield attached thereto is at a lowered position relative to a helmet comprising the pivot mechanism.

In some embodiments a helmet may comprise two shields, an inner shield and an outer shield, wherein the inner shield, the outer shield, or both the inner and outer shield are engaged with a pair of pivot mechanisms disclosed herein.

In embodiments wherein both the inner shield and the outer shield are engaged with pivot mechanisms disclosed herein, the outer shield may be engaged with pivot mechanisms such as the first and second pivot mechanisms described above, where the second pivot mechanism is in operable communication with first control mechanism such as a cable movement mechanism described above. The inner shield may be engaged with third and fourth pivot mechanisms similar to the first and second pivot mechanisms described above, where the fourth pivot mechanism is in operable communication with a control mechanism such as a cable movement mechanism as described above. In these embodiments, the third and fourth pivot mechanisms engaged to the inner shield are mounted closer to the interior of the helmet than the first and second pivot mechanisms. The virtual pivots of the pivot mechanisms engaged to the outer shield and the virtual pivots of the pivot mechanisms engaged to the inner shield need not lie on the same axes. In embodiments, the first and second control mechanisms may be located on the same side of the helmet, or on different sides of the helmet.

In the embodiments shown in FIGS. 1-9 herein, the curved track comprises an arc having an essentially constant radius of curvature, but this is not limiting. In other embodiments the curved track may have a portion defining an arc with a first radius of curvature and a second portion defining a second arc having a different radius of curvature and/or a different virtual pivot. For example, the first portion of the track may lower the shield when advancing away from the first position until it is in front of a wearer's eyes or face, and the second portion may cause the shield to be pulled toward the helmet to seal against the brow region and/or the upper edge of a chin bar of a closed face helmet.

When the shield covers the eyeport in a closed face shield, a peripheral seal around the eyeport seals against the inside surface of the shield to prevent ingress of air, water, and debris into the interior of the helmet.

Under certain environmental conditions, the inner surface of the shield when closed and sealed is susceptible to condensation formation or "fogging," which can interfere with a rider's vision and thus must be eliminated. A method of clearing a shield fogged with condensation is simply to open the shield to allow outside air into the helmet. However, opening the shield too far while moving can allow high velocity air to hit the riders face and eyes, which is uncomfortable and dangerous. It thus is imperative when employing this method that the shield be opened or cracked by a small amount that is just enough to break contact between the shield and the peripheral seal around the eyeport. Cracking the shield slightly in this way admits a sufficient stream of outside air to clear condensation but does not allow an excessive airflow that might interfere with the rider's comfort or vision.

Most helmets incorporate shield set positions or "detents" through which the shield passes as it is moved from its closed position to its open position. In most cases, however, the first detent or first open position is too large for use in clearing a fogged shield because it allows high velocity air to hit the rider's face and eyes. Some recent close faced helmets incorporate a mechanism for cracking or venting the shield slightly when desired.

Pivot mechanisms as described herein can address this problem. As discussed above, the curved track can comprise first and second portions, wherein the locus where the first portion transitions to the second portion defines an intermediate position between the first and second positions. The first portion provides an arc for raising or lowering the shield and the second portion provides an arc for moving the shield to a cracked position when the clamp is at the intermediate position or closed position when the clamp is at its second position.

Figure 10A:
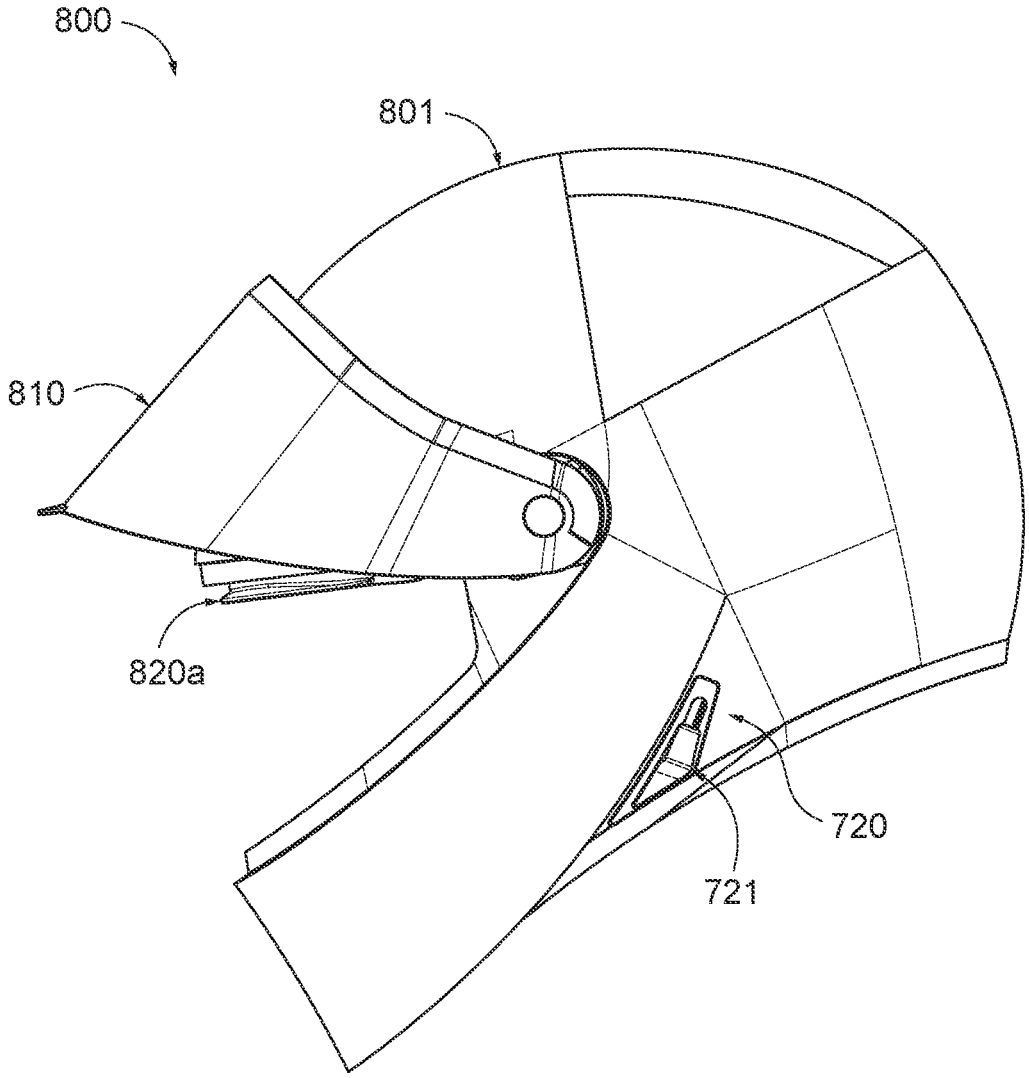
FIGS. 10A and 10B show side views of a helmet incorporating the pivot mechanism and an inner shield attached thereto with the shield in raised and lowered positions respectively, according to an exemplary embodiment of the disclosed subject matter.
Figure 10B:
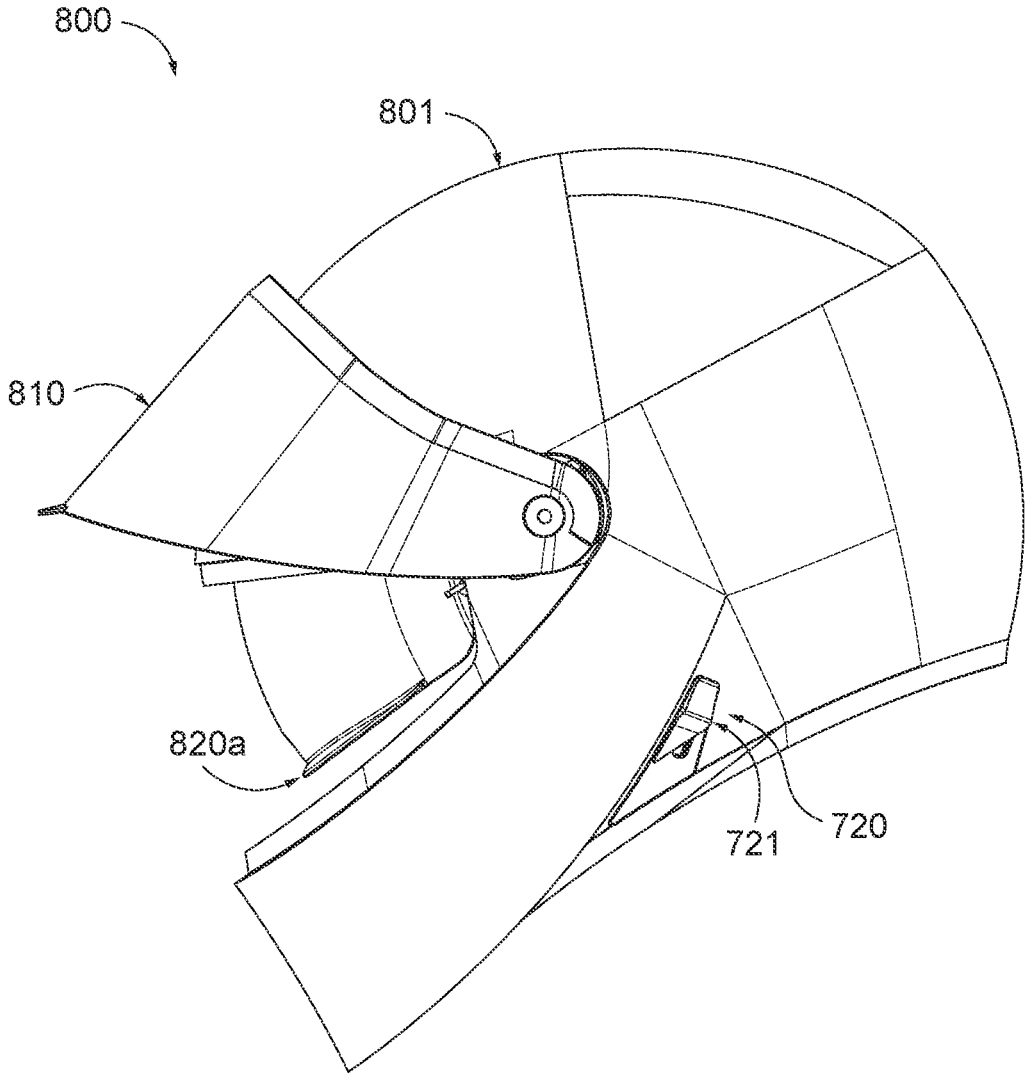

FIGS. 10A and 10B show side views of a helmet incorporating the pivot mechanism and an inner shield attached thereto with the shield in raised and lowered positions respectively. Helmet 800 comprises an outer shell 801 and outer shield 810. Outer shield 810 is depicted in its raised or open configuration to allow the inner shield to be seen. The control mechanism 720 is located proximate the lower edge of helmet 800. In FIG. 10A, the inner shield is shown in its raised position 820*a*. In this embodiment, slider 721 is shown at its distal position at the bottom end of control mechanism 720, corresponding to the cable being in its retracted configuration as described above. In FIG. 10B, the inner shield is shown in its lowered position 820*b*. In this embodiment, slider 721 is shown at its proximal position at the top end of control mechanism 720, corresponding to the cable being in its extended configuration as described above.

Figure 11A:
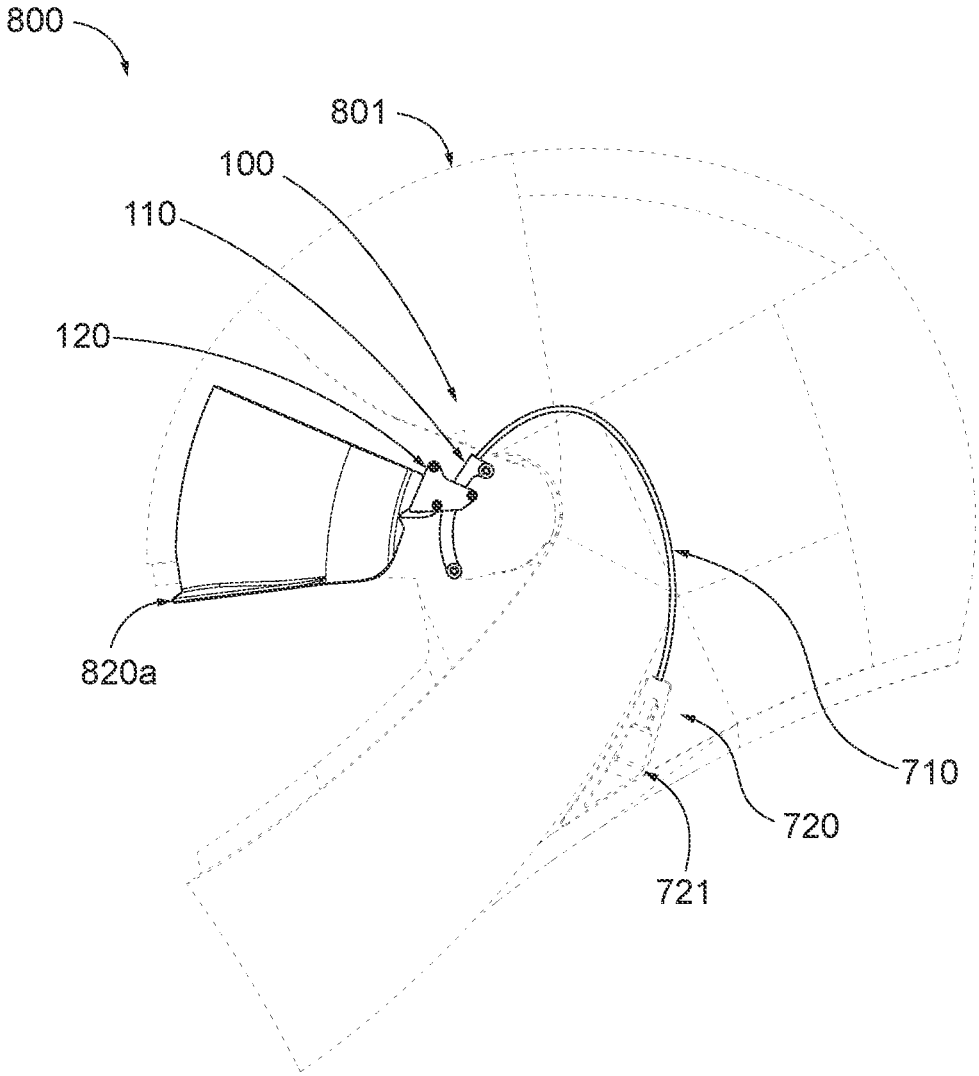
FIGS. 11A and 11B show cutaway views of a helmet incorporating the pivot mechanism and an inner shield attached thereto with the shield in raised and lowered positions respectively, according to an exemplary embodiment of the disclosed subject matter.
Figure 11B:
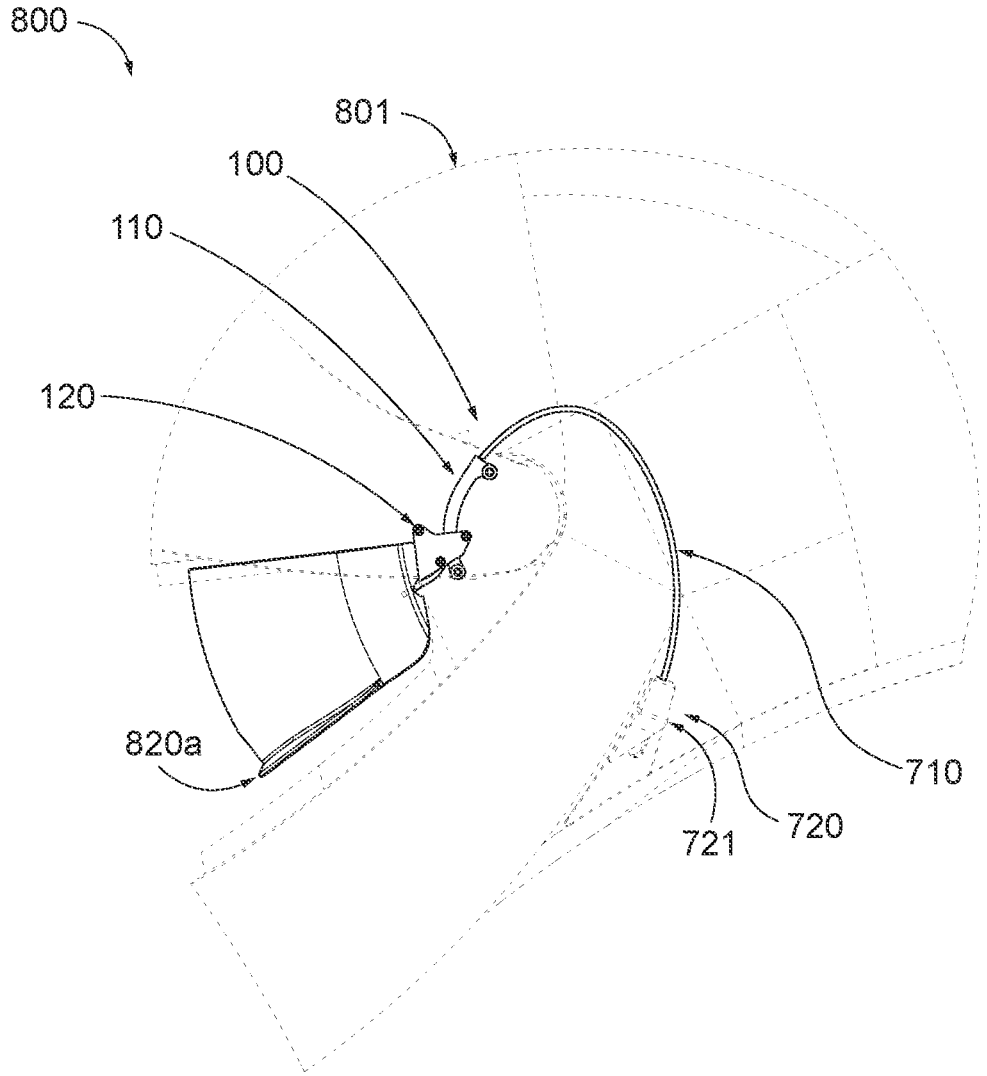

FIGS. 11A and 11B show cutaway views of a helmet incorporating the pivot mechanism and an inner shield attached thereto with the shield in raised and lowered positions respectively. In these views, outer shell 801 is shown as transparent allowing the pivot mechanism 100 to be shown inside helmet 800. Track member 110 and clip member 120 are shown, wherein the inner shield is engaged to clip member 120. Cable guide tube 710 is shown, connecting the first end of track member 110 to the control mechanism 720. In FIG. 11A, the inner shield is shown in its raised position 820*a*. In this embodiment, slider 721 is shown at its distal position at the bottom end of control mechanism 720, corresponding to the cable being in its retracted configuration as described above, which moves clip member 120 toward the first end of track member 110 and raising inner shield to its raised position 820*a*. In FIG. 11B, the inner shield is shown in its lowered position 820*b*. In this embodiment, slider 721 is shown at its proximal position at the top end of control mechanism 720, corresponding to the cable being in its extended configuration as described above, which moves clip member 120 toward the second end of track member 110 and lowering inner shield to its lowered position 820*b*.

The embodiments illustrated in FIGS. 1 through 11B illustrate a pivot mechanism and a helmet comprising the pivot mechanism wherein when the clamp is at its first position a shield attached thereto is at a raised position relative to the helmet; and wherein the clamp is at its second position a shield attached thereto is at a lowered position relative to the helmet.

In those embodiments, the first position is indicated when the clamp is proximate to end 113 and the second position is indicated when the clamp is proximate to end 114. Further, the pivot mechanism in those embodiments comprise a cable guide 112 and a cable detent 142 on slider member 140 that are disposed at the top of the pivot mechanism (relative to a helmet comprising the pivot mechanism). When a cable is engaged to the cable guide and cable detent and retracted distally, a shield engaged in the pivot mechanism is brought to the first position and is in a raised configuration. When the cable is advanced proximally, the shield is brought to the second position and is in a lowered configuration.

Further, when the cable is engaged to a control mechanism 720 as described herein, when the slider bar is at its first position, the clamp is at its first position and a shield attached thereto is at a raised position relative to a helmet comprising the pivot mechanism; and wherein the slider bar is at its second position, the clamp is at its second position and a shield attached thereto is at a lowered position relative to a helmet comprising the pivot mechanism.

Alternatively, other embodiments of the pivot mechanism and a helmet comprising the pivot mechanism include those wherein when the clamp is at its first position a shield attached thereto is at a lowered position relative to the helmet; and wherein the clamp is at its second position a shield attached thereto is at a lowered position relative to the helmet.

In such embodiments, the first position is indicated when the clamp is proximate to the bottom end and the second position is indicated when the clamp is proximate to the top end (each (relative to a helmet comprising the pivot mechanism). Further, the pivot mechanism in such embodiments may comprise a cable guide and a cable detent on the slider member that are disposed at the bottom of the pivot mechanism (relative to a helmet comprising the pivot mechanism). When a cable is engaged to the cable guide and cable detent and retracted distally, a shield engaged in the pivot mechanism is brought to the first position and is in a lowered configuration. When the cable is advanced proximally, the shield is brought to the second position and is in a raised configuration.

Further, when the cable is engaged to a control mechanism such as described herein, when the slider bar is at its first position, the clamp is at its first position and a shield attached thereto is at a lowered position relative to a helmet comprising the pivot mechanism; and wherein the slider bar is at its second position, the clamp is at its second position and a shield attached thereto is at a raised position relative to a helmet comprising the pivot mechanism.

Where the above examples, embodiments and implementations reference examples, it should be understood by those of ordinary skill in the art that other helmet and devices and examples could be intermixed or substituted with those provided as virtually any component consistent with the intended operation of a method, system, or implementation may be utilized. Accordingly, for example, although particular component examples may be disclosed, such components may be comprised of any shape, size, style, type, model, version, class, grade, measurement, concentration, material, weight, quantity, and/or the like consistent with the intended purpose, method and/or system of implementation. In places where the description above refers to particular embodiments of helmets and pivot mechanisms, it should be readily apparent that a number of modifications may be made without departing from the spirit thereof and that these embodiments and implementations may be applied to other to gear and equipment technologies as well. Accordingly, the disclosed subject matter is intended to embrace all such alterations, modifications, and variations that fall within the spirit and scope of the disclosure and the knowledge of one of ordinary skill in the art. The presently disclosed embodiments are, therefore, to be considered in all respects as illustrative and not restrictive.

The invention claimed is:

1. A pivot mechanism for a shield for a helmet, the pivot mechanism comprising a curved track having a first end and a second end, an inside radius side, and outside radius side and a width therebetween; and a clamp slidingly engaged to the curved track, wherein the clamp is configured to attach to an end of the shield and slide along the curved track between a first position proximate to the first end of the curved track and a second position proximate to the second end of the curved track, the clamp comprising at least one first raised track engagement feature configured to slidably engage the inside radius side of the curved track, at least one second raised track engagement feature configured to slidably engage the outside radius side of the curved track.

2. The pivot mechanism of claim 1 wherein the clamp comprises a passageway wherein at least a portion of an interior surface of the passageway slidingly engages at least a portion of an exterior surface of the curved track; and a recess configured to engage the end of the shield to attach the clamp thereto.

3. A pivot mechanism for a shield for a helmet, the pivot mechanism comprising a curved track having a first end and a second end; and a clamp slidingly engaged to the curved track, wherein the clamp is configured to attach to an end of the shield and slide along the curved track between a first position proximate to the first end of the curved track and a second position proximate to the second end of the curved track, further comprising (a) a track member comprising the curved track having the first end and the second end, an inside radius side, an outside radius side and a fixed width therebetween, a first raised portion proximate to the first end, and a second raised portion proximate to the second end; and (b) the clamp comprises (i) a clip member comprising a generally planar region having a first surface and an opposed second surface, and one or more raised portions on the first surface; and (ii) a slider member attached to the clip member, the slider member comprising a generally planar region having a first surface and a second surface, wherein the first surface of the clip member and the first surface of the slider member face each other and the generally planar region of the clip member and the generally planar region of the slider are spaced apart and substantially parallel, at least one first raised track engagement feature configured to slidably engage the inside radius side of the curved track, at least one second raised track engagement feature configured to slidably engage the outside radius side of the curved track, wherein a first portion of the generally planar region of the clip member, a first portion the generally planar region of the slider member, the at least one first raised track engagement feature and the at least one second raised track engagement feature define a passageway slidingly engaged around the curved track, and a second portion of the generally planar region of the clip member, and a second portion of the generally planar region of the slider member define an open cavity for insertion of an end of the shield, and wherein the first position is defined when a first portion of the clamp is in contact with the first raised portion of the track member, and the second position is defined when a second portion of the clamp is in contact with the second raised portion of the track member.

4. The pivot mechanism of claim 3 wherein an end of said shield is inserted in the open cavity and is held therein.

5. The pivot mechanism of claim 3 further comprising a lever rotatably engaged to a pivot rod between the clip member and the slider member and the lever is configured to releasably engage an end of said shield inserted in the open cavity and hold it therein.

6. The pivot mechanism of claim 3 wherein the track member comprises a second raised portion proximate to the first end comprising a cable guide, and wherein the second surface of the slider member comprises a raised portion comprising a cable end detent;

wherein the pivot mechanism further comprises a cable configured to move within the cable guide and the cable end is held in the cable end detent, wherein when the cable is advanced distally from the cable guide the clamp is moved toward the second position, and when the cable is retracted proximally toward the cable guide the clamp is moved toward the first position.

7. The pivot mechanism of claim 6 further comprising a cable movement mechanism remote from the pivot mechanism and in operable communication with the pivot mechanism via a cable, the cable movement mechanism comprising a first position and a second position; and a cable guide tube comprising a lumen in which the cable is movably contained, the cable guide tube running between the cable guide on the track member to a second cable guide associated with the cable movement mechanism, wherein the cable comprises a second cable end engaged with a second cable end detent on the cable movement mechanism;

wherein the first position of the cable movement mechanism defines a position wherein the cable is retracted and the clamp is in its first position of the pivot mechanism and the second position of the cable movement mechanism defines a position wherein the cable is advanced and the clamp is in its second position of the pivot mechanism.

8. The pivot mechanism of claim 7 wherein the cable movement mechanism comprises a slider bar, wherein when the slider bar is moved distally from the second cable guide, the cable is retracted from the pivot mechanism and the clamp is moved toward the first position of the pivot mechanism; and wherein when the slider bar is moved proximally toward the second cable guide the cable is advanced in the pivot mechanism and the clamp is moved toward the second position of the pivot mechanism.

9. The pivot mechanism of claim 8 wherein when the slider bar is at its first position, the clamp is at its first position and said shield attached thereto is at a raised position relative to helmet comprising the pivot mechanism; and wherein the slider bar is at its second position, the clamp is at its second position and said shield attached thereto is at a lowered position relative to a helmet comprising the pivot mechanism.

10. A helmet comprising:

a shell;

an inner shield on said shell movable between a lowered position covering the eye region of a user wearing the helmet and a raised position displaced from said eye region; and a pivot mechanism according to claim 1 wherein an end of said inner shield is attached to the clamp.

11. The helmet of claim 10 wherein said inner shield is in its raised position when the clamp of the pivot mechanism is in its first position and said shield is in its lowered position when the clamp of the pivot mechanism is in its second position.

12. The helmet of claim 10 further comprising a mechanism in operational communication with the pivot mechanism to raise or lower said inner shield.

13. The helmet of claim 10 comprising an outer shield wherein the pivot mechanism is attached to said inner shield.

14. The helmet of claim 10 comprising an outer shield wherein a first pivot mechanism is attached to said inner shield and a second pivot mechanism is attached to said outer shield.

15. A helmet comprising:

a shell;

an inner shield on said shell movable between a lowered position covering the eye region of a user wearing the helmet and a raised position displaced from said eye region; and a pivot mechanism comprising a curved track having a first end and a second end; and a clamp slidingly engaged to the curved track, wherein the clamp is configured to slide along the curved track between a first position proximate to the first end of the curved track and a second position proximate to the second end of the curved track; wherein the clamp comprises a passageway wherein at least a portion of an interior surface of the passageway slidingly engages at least a portion of an exterior surface of the curved track; and a recess configured to engage the end of said inner shield to attach the clamp thereto.

16. A helmet comprising:

a shell;

an inner shield on said shell movable between a lowered position covering the eye region of a user wearing the helmet and a raised position displaced from said eye region; and a pivot mechanism comprising a curved track having a first end and a second end; and a clamp slidingly engaged to the curved track, wherein the clamp is configured to slide along the curved track between a first position proximate to the first end of the curved track and a second position proximate to the second end of the curved track;

wherein an end of said inner shield is attached to the clamp;

the pivot mechanism comprises (a) a track member comprising the curved track having the first end and the second end, an inside radius side, an outside radius side and a fixed width therebetween, a first raised portion proximate to the first end, and a second raised portion proximate to the second end; and (b) the clamp comprises (i) a clip member comprising a generally planar region having a first surface and an opposed second surface, and one or more raised portions on the first surface; and (ii) a slider member attached to the clip member, the slider member comprising a generally planar region having a first surface and a second surface, wherein the first surface of the clip member and the first surface of the slider member face each other and the generally planar region of the clip member and the generally planar region of the slider are spaced apart and substantially parallel, at least one first raised track engagement feature configured to slidably engage the inside radius side of the curved track, at least one second raised track engagement feature configured to slidably engage the outside radius side of the curved track, wherein a first portion of the generally planar region of the clip member, a first portion the generally planar region of the slider member, the at least one first raised track engagement feature, and the at least one second raised track engagement feature define a passageway slidingly engaged around the curved track, and a second portion of the generally planar region of the clip member, and a second portion the generally planar region of the slider member define an open cavity for insertion of an end of said inner shield, and wherein the first position is defined when a first portion of the clamp is in contact with the first raised portion of the track member, and the second position is defined when a second portion of the clamp is in contact with the second raised portion of the track member.

17. The helmet of claim 16 further comprising a cable movement mechanism remote from the pivot mechanism and in operable communication with the pivot mechanism via a cable, the cable movement mechanism comprising a first position and a second position; and a cable guide tube comprising a lumen in which the cable is movably contained, the cable guide tube running between a cable guide on the track member to a second cable guide associated with the cable movement mechanism, wherein the cable comprises a second cable end engaged with a second cable end detent on the cable movement mechanism;

wherein the first position of the cable movement mechanism defines a position wherein the cable is retracted and the clamp is in its first position of the pivot mechanism and the second position of the cable movement mechanism defines a position wherein the cable is advanced and the clamp is in its second position of the pivot mechanism.

18. The helmet of claim 17 wherein the cable movement mechanism comprises a slider bar, wherein when the slider bar is moved distally from the second cable guide, the cable is retracted from the pivot mechanism and the clamp is moved toward the first position of the pivot mechanism; and wherein when the slider bar is moved proximally toward the second cable guide the cable is advanced in the pivot mechanism and the clamp is moved toward the second position of the pivot mechanism.

19. The helmet of claim 18 wherein when the slider bar is at its first position, the clamp is at its first position and the shield attached thereto is at a raised position; and wherein when the slider bar is at its second position, the clamp is at its second position and said inner shield attached thereto is at a lowered position.

* * * * *